US006256004B1

(12) United States Patent
Izumi et al.

(10) Patent No.: US 6,256,004 B1
(45) Date of Patent: Jul. 3, 2001

(54) LIQUID CRYSTAL DISPLAY DEVICE AND DRIVING METHOD THEREOF

(75) Inventors: Yoshihiro Izumi, Kashihara; Tokihiko Shinomiya, Nara; Manabu Matsuura, Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/984,084

(22) Filed: Dec. 3, 1997

(30) Foreign Application Priority Data

Dec. 27, 1996 (JP) ..... 8-349722

(51) Int. Cl.[7] ..... G09G 3/36
(52) U.S. Cl. ..... 345/88; 345/98
(58) Field of Search ..... 345/88, 103, 87, 345/89, 98, 99, 100; 349/139, 143, 149

(56) References Cited

U.S. PATENT DOCUMENTS 4,679,043 * 7/1987 Morokawa ..... 345/103
5,731,794 * 3/1998 Miyazawa ..... 345/88

FOREIGN PATENT DOCUMENTS 8-122769 5/1996 (JP) .
8-146455 6/1996 (JP) .

* cited by examiner

*Primary Examiner*—Xiao Wu
(74) *Attorney, Agent, or Firm*—Nixon & Vanderhye P.C.

(57) ABSTRACT

A large-area liquid crystal display device of the present invention is fabricated by arranging liquid crystal panels to form a plane surface and connecting the panels at their edges parallel to a first direction corresponding to an up-and-down direction of a displayed image to be obtained. Each liquid crystal panel has pixels which are arranged in a matrix form and include color filters and pixel electrodes arranged in the first direction to correspond to the color filters, scanning lines arranged in the first direction, and signal lines arranged in a second direction intersecting the first direction. When driving the liquid crystal display device, the arrangement of image data for performing line sequential scanning in the first direction is changed into an arrangement for performing line sequential scanning in the second direction using a memory. This structure realizes a large-area liquid crystal display device capable of providing a high-quality displayed image with a less noticeable joint of the liquid crystal panels.

23 Claims, 15 Drawing Sheets

LIQUID CRYSTAL DISPLAY DEVICE AND DRIVING METHOD THEREOF

FIELD OF THE INVENTION

The present invention relates to liquid crystal display devices which can be used in audio vidual (AV) equipment and office automation (OA) machines, and easily provide large-area displays.

BACKGROUND OF THE INVENTION

There have been demands for light weight, thin, low power-consuming, high definition, large-area display devices for use in AV equipment like home-use television sets and in OA machines. Therefore, the development of large-area displays for actual applications has been carried out in respect of display devices such as cathode ray tube display (CRT), liquid crystal display (LCD), plasma display (PDP), electro-luminescence display (EL) and light emitting diode display (LED).

In particular, liquid crystal display devices are advantageous because they can have much smaller thickness (depth) and power consumption, and easily provide a full-color display compared to display devices of other types. For this reason, in resent years, liquid crystal display devices have been used in various fields, and large-area liquid crystal displays have been greatly expected.

However, when fabricating a large-area liquid crystal display device with a conventional structure, the ratio of defects such as disconnection of signal lines and defective pixels abruptly increase during the fabrication process. The increase in the defection ratio causes such a problem that the price of the liquid crystal display device rises. In order to solve this problem, a large-area liquid crystal display device has been fabricated by simply connecting a plurality of liquid crystal panels together.

However, in the large-area liquid crystal display device fabricated in this method suffers from drawbacks that the joint in a display formed by the liquid crystal panels is noticeable, and displayed images have degraded display quality. In order to obtain natural displayed images, it is necessary to render the joint in the display of the liquid crystal display panels less noticeable.

Therefore, as a method for making the joint in the display of a large-area liquid crystal display device less noticeable, the present inventors proposed to dispose three pixel electrodes corresponding to red (R), green (G) and blue (B) filters at positions which are separated from the connected section of the liquid crystal panels by the same distance in Japanese Publication of Unexamined Patent Application No. 146455/1996 (Tokukaihei 8-146455).

In a large-area liquid crystal display device fabricated in this method, as illustrated in FIG. 13, liquid crystal panels 101 include pixels 113 arranged in matrix form, and each pixel 113 includes three pixel electrodes 114 which corresponds to R, G and B filters and are arranged in the order R, G and B (hereinafter referred to as the RGB order) so as to be separated from a connected section 111 by substantially the same distance. More specifically, the three pixel electrodes 114 are aligned in a direction parallel to the connected section 111 (the Y-axis direction in FIG. 13) that is an up-and-down direction of a displayed image (for example, a building) on the display.

As shown in FIG. 14, the pixels 113 are driven by TFT elements 115 which are respectively connected to the pixel electrodes 114 corresponding to R, G and B. Specifically, the TFT elements 115 are connected to signal lines 117 and scanning lines 118 which are respectively insulated by insulating films 116. Each of the pixel electrodes 114 is independently driven by the TFT element 115.

In this structure, even when light passing through the color filters corresponding to the pixels 113 located adjacent to the connected section 111 is refracted or scattered in the connected section 111, the degree of color modulation is substantially uniform in the respective pixels 113. Therefore, the color balance of light does not vary with respect to light coming from a direction oblique to the pixels 113 near the connected section 111, thereby preventing regions of different color tones from being produced in the connected section 111. Consequently, the joint in the large-area liquid crystal display becomes less noticeable.

Thus, by joining two pieces of liquid crystal panels together and rendering the joint in the display less noticeable, it is possible to provide displayed images with high quality.

However, in the alignment of pixel electrodes according to the method of the above-mentioned publication, Japanese Publication of Unexamined Patent Application No. 146455/1996, the length of each signal line 117 becomes at least twice longer than that of a conventional structure. Therefore, the delay of an electric signal functioning as a drive signal for providing a displayed image in the signal line 117 increases, causing vicious effects on the displayed image.

More specifically, in a conventional active-matrix type liquid crystal display device performing line-sequential scanning, signal lines are provided along the Y-axis direction shown in FIG. 14. In such a device, scanning lines are provided along the X-axis direction shown in FIG. 14 that crosses at right angles with the Y-axis direction. As described above, the Y-axis direction is the up-and-down direction (vertical direction) of a displayed image, for example, a building on the display, and the X-axis direction is the lateral direction of the displayed image.

Meanwhile, in a liquid crystal display device fabricated according to the method disclosed in Japanese Publication of Unexamined Patent Application No. 146455/1996, the pixel electrodes 114 are driven by drive signals similar to those of the conventional active-matrix type liquid crystal display device. In this device, the signal lines 117 are arranged in a shape like a square bracket around the pixel electrodes 114 so that the signal lines 117 are provided along the Y-axis direction. Consequently, the length of each signal line becomes at least twice longer than that of the conventional structure. Hence, in a large-area liquid crystal display device, when the signal lines 117 are arranged in such a manner, electric signals are delayed, causing vicious effects on displayed images.

In addition, since the number of crossings where the scanning lines 118 intersect the signal lines 117 through the insulating films 116 therebetween increases, defects are likely to occur due to an electrical short circuit at the crossings.

SUMMARY OF THE INVENTION

In order to solve the above problems, it is an object of the present invention to provide a liquid crystal display device capable of improving the quality of displayed images and reduce the ratio of defects by maintaining an arrangement of pixel electrodes for rendering the joint in the display less noticeable and adopting a simpler structure of signal lines and scanning lines, and provide a method of driving the liquid crystal display device.

In order to achieve the above object, a liquid crystal display device of the present invention has a liquid crystal panel including:

a plurality of pixels arranged in a matrix form;

a plurality of color filters provided in each of said pixels for enabling the pixels to provide a color display, the color filters in each pixel being arranged in a first direction corresponding to an up-and-down direction of a displayed image to be obtained;

pixel electrodes corresponding to the color filters, respectively;

a plurality of scanning lines arranged in the first direction for driving the pixel electrodes; and a plurality of signal lines arranged in a second direction intersecting the first direction for driving the pixel electrodes.

In this structure, by driving the pixel electrodes corresponding to the respective color filters through the scanning lines and signal lines, the pixels can provide a color display. Moreover, by arranging the scanning lines along the first direction, it is possible to arrange the signal lines in straight lines along the second direction. Namely, unlike the conventional structure, there is no need to arrange the sinal lines in the form of a square bracket.

Consequently, the length of each signal line can be made shorter than that of the conventional structure, thereby reducing a delay of image display signals as electrical signals. Furthermore, in this structure, it is possible to prevent the number of intersections of the scanning lines and signal lines from being increased like in the conventional structure, thereby decreasing defects caused by an electrical short circuit at the intersections.

Additionally, a large-area liquid crystal display device of the present invention is fabricated by arranging a plurality of the liquid crystal panels so that display surfaces of the liquid crystal panels having the pixels thereon form a plane surface, and connecting the liquid crystal panels to each other at their edges parallel to the first direction.

In this structure, the pixel electrodes are formed along the first direction so that they are separated from the connected sections of the liquid crystal panels by the same distance. Therefore, even when light passing through the color filters corresponding to the pixel electrodes located near the connected section is scattered and refracted, the degree of color modulation of the pixels electrodes is uniform.

Thus, in this structure, since the color balance of light is not lost by light from a direction oblique to the pixels located near the connected section, regions having different color tones are not produced in the connected section. As a result, the joint in the display is made less noticeable, thereby providing a large-area display with improved quality.

A method of the present invention for driving a liquid crystal display device having a liquid crystal panel including pixel electrodes, a plurality of scanning lines arranged in a first direction corresponding to an up-and-down direction of a displayed image to be obtained for driving the pixel electrodes, a plurality of signal lines arranged in a second direction intersecting the first direction for driving the pixel electrodes, is characterized in including the steps of:

storing image data temporarily for performing line sequential scanning in the first direction; and changing an arrangement of the image data and outputting the image data for performing line sequential scanning in the second direction.

In this method, since the scanning lines and signal lines are arranged in the above-mentioned manner, there is a need to change a line sequential scanning direction from the first direction to the second direction intersecting the first direction. Therefore, by storing the image data corresponding to the first direction temporarily and changing the arrangement of the image data to the second direction, it is possible to provide a display like a conventional liquid crystal display device.

Moreover, in this method, it is possible to reduce the delay of image display signals, and decrease the ratio of defects. Furthermore, when more than one piece of the liquid crystal panels are connected together, it is possible to provide a large-area display with improved quality.

Another liquid crystal display device of the present invention has a liquid crystal panel including:

a plurality of pixels arranged in a matrix form;

a plurality of color filters provided in each of the pixels for enabling the pixels to provide a color display, the color filters in each pixel being arranged in a first direction corresponding to an up-and-down direction of a displayed image to be obtained;

pixel electrodes corresponding to the color filters, respectively;

a plurality of signal lines arranged in the first direction for driving the pixel electrodes of each pixel; and a plurality of scanning lines arranged in a second direction intersecting the first direction for driving the pixel electrodes, the scanning lines corresponding to the pixel electrodes arranged in the second direction, respectively.

In this structure, by driving the pixel electrodes through the scanning lines and signal lines corresponding to the respective color filters, the pixels can provide a color display. Moreover, in this structure, a scanning line is arranged along the second direction for each of the pixel electrodes. It is therefore possible to arrange signal lines in straight lines for the respective pixel electrodes. Namely, unlike the conventional structure, there is no need to arrange the signal lines in the form of a square bracket. As a result, the length of each signal line can be made shorter than that of the conventional structure, thereby reducing a delay of image display signals as electrical signals. Furthermore, in this structure, it is possible to prevent the number of intersections of the scanning lines and signal lines from being increased like in the conventional structure, thereby decreasing defects caused by an electrical short circuit.

Another driving method of the present invention for driving a liquid crystal display device having a liquid crystal panel including pixels arranged in a matrix form, pixel electrodes provided in the pixels, a plurality of signal lines arranged in a first direction corresponding to an up-and-down direction of a displayed image to be obtained for driving said pixel electrodes, a plurality of scanning lines arranged in a second direction intersecting the first direction for driving said pixel electrodes, characterized in including the steps of:

decomposing image data of a color display into a plurality of color image data corresponding to said pixel electrodes, respectively;

storing the color image data temporarily;

outputting the color image data in a predetermined order; and performing line sequential scanning of said pixel electrodes in the first direction according to the plurality of color image data.

In this method, since the scanning lines and the signal lines are arranged in the above-mentioned manner, line sequential scanning of display needs to be performed for each pixel electrode. Therefore, first, the image data is decomposed into a plurality of color image data according to primary colors of a color display. Next, the plurality of color image data are concurrently stored temporarily. Thereafter, each color image data is individually output to the liquid crystal panel, and line sequential scanning is performed for each color of the pixel electrodes. Consequently, it is possible to provide a display like a conventional liquid crystal display device, reduce the delay of image display signals, and decrease the ratio of defects. Furthermore, when liquid crystal panels are joined together, this method can provide a large displayed image with improved quality.

For a fuller understanding of the nature and advantages of the invention, reference should be made to the ensuing detailed description taken in conjunction with the accompanying drawings.

DESCRIPTION OF THE PREFERRED EMBODIMENTS

Embodiment 1

Figure 1:
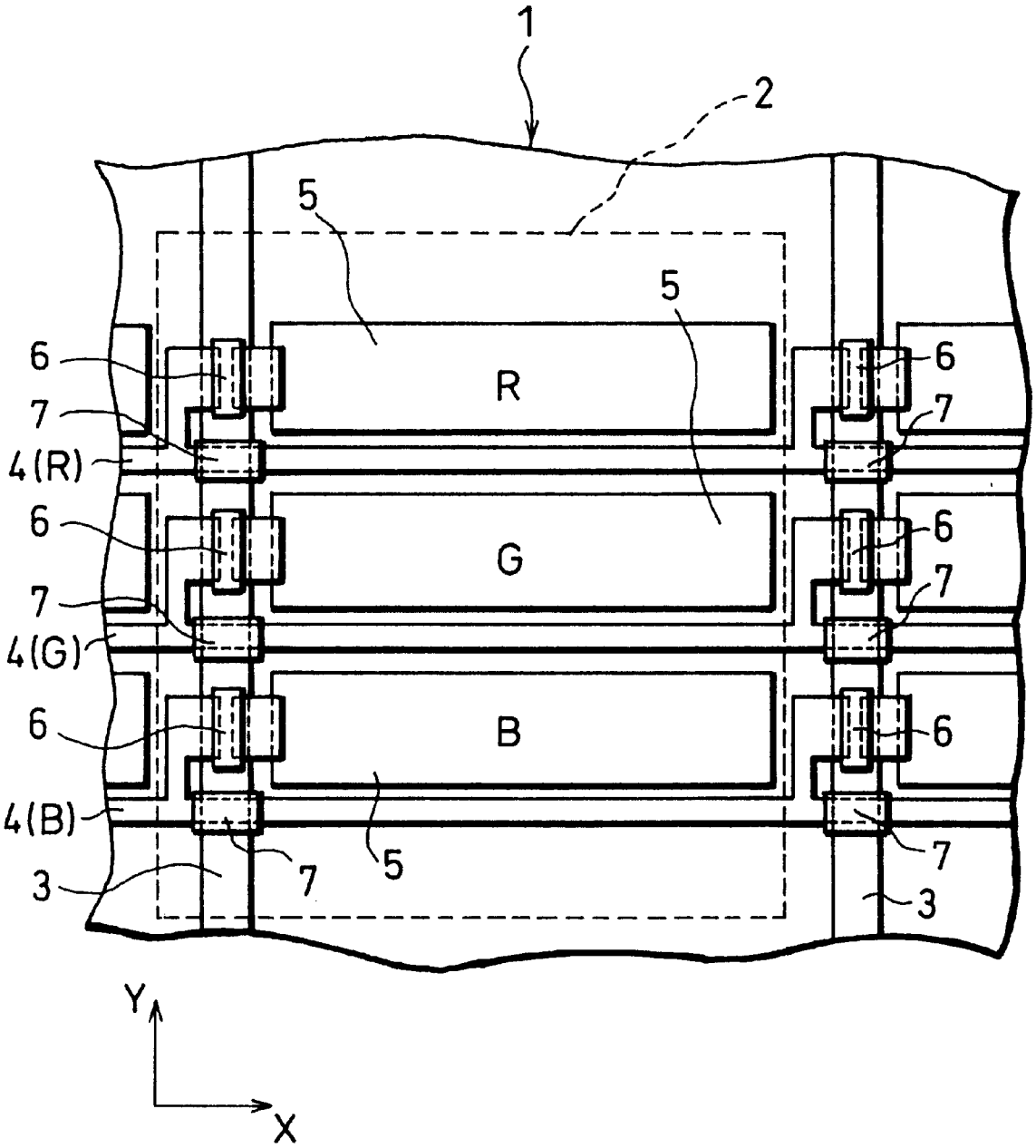
FIG. 1 is a schematic plan view showing in detail a pixel section of a liquid crystal display device according to one embodiment of the present invention.
Figure 2:
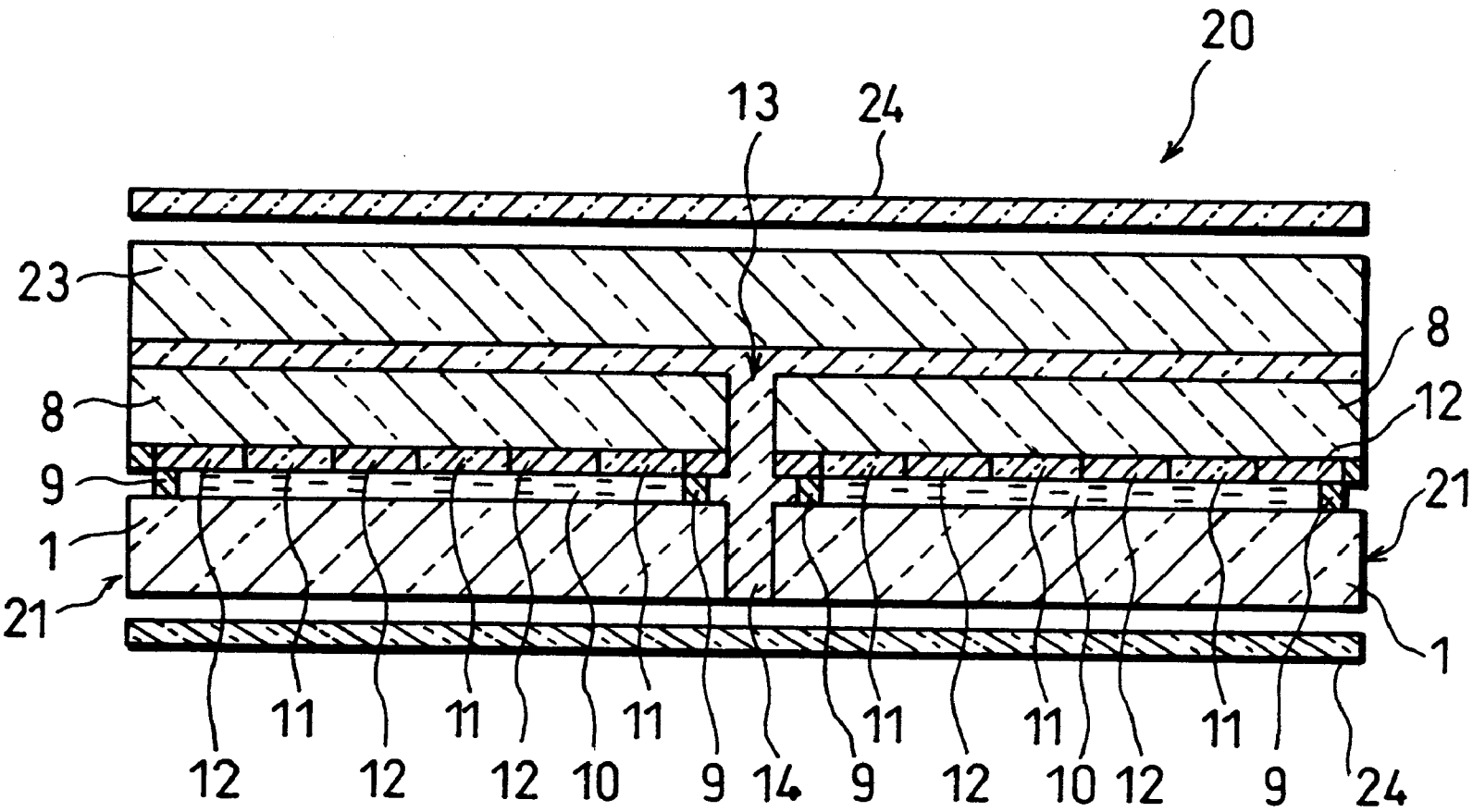
FIG. 2 is a schematic cross section of the liquid crystal display device.
Figure 3:
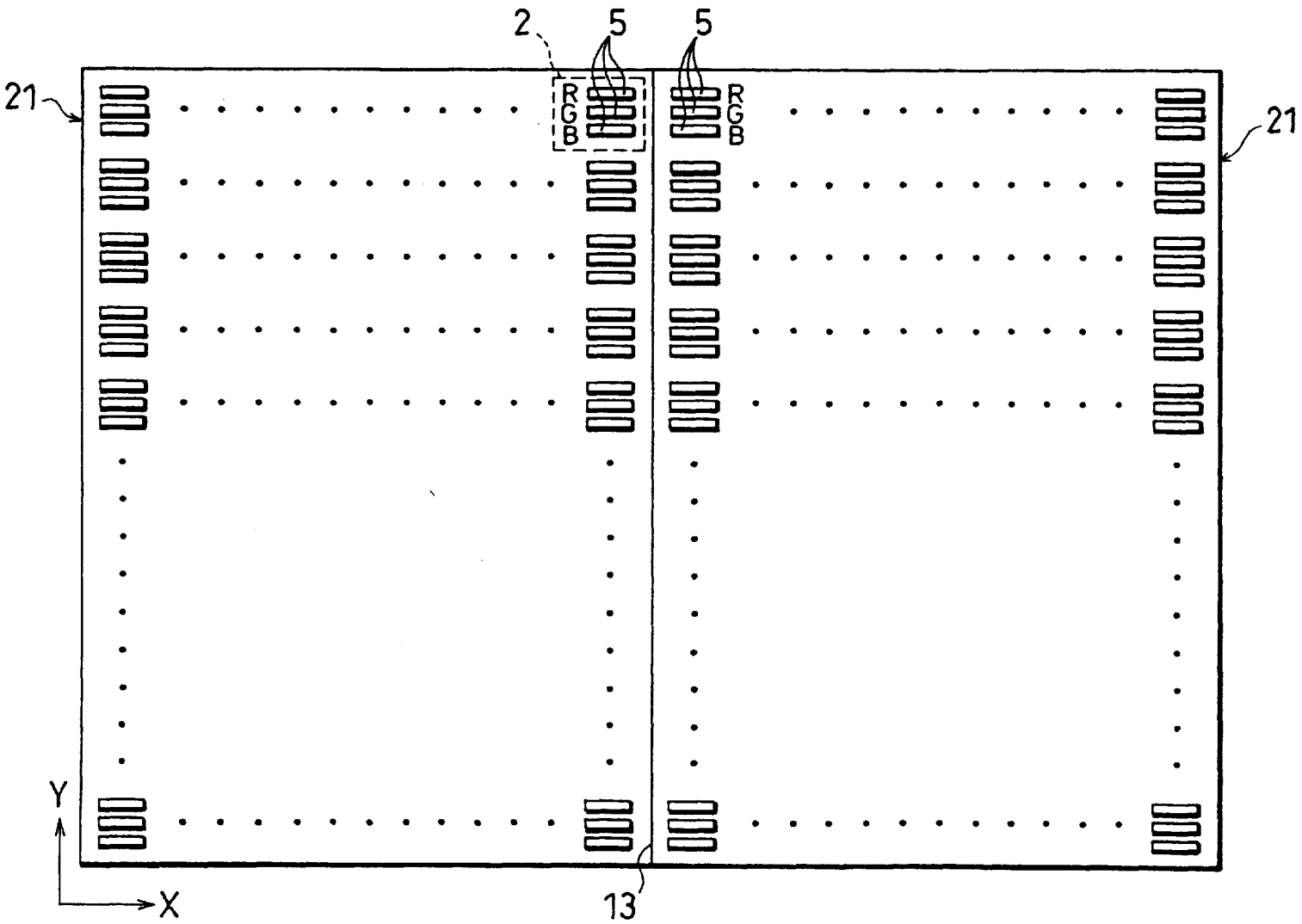
FIG. 3 is a schematic plan view of the liquid crystal display device shown in FIG. 2.

The following description will explain one embodiment of the present invention with reference to FIGS. 1 to 7. This embodiment explains a large-area liquid crystal display device 20 capable of providing a color display, which is fabricated by connecting two pieces of rectangular-plate-like liquid crystal panels 21 to each other adjacently at their longitudinal side faces, i.e., a connected section 13, as shown in FIGS. 2 and 3. However, the present invention is not limited to this embodiment.

In the liquid crystal display device 20 of this embodiment, as illustrated in FIG. 2, the two liquid crystal panels 21 are fastened to a plane surface of a piece of large transparent substrate 23 made of, for example, glass with an index adjusting material 14 having a light-transmitting property so that the display surfaces of the two liquid crystal panels 21 form a single plane surface. Moreover, these liquid crystal panels 21 are juxtaposed and connected to each other with the index adjusting material 14. Furthermore, the connected liquid crystal panels 21 are sandwiched between a pair of polarizing plates 24. The polarizing plates 24 are disposed in a crossed nicol state in which the polarizing axes thereof cross at right angles with each other.

In the liquid crystal panel 21, a thin film transistor substrate (hereinafter referred to as the TFT substrate) 1 and a counter substrate 8 are disposed to face each other, and stack together with a sealing material 9 made of, for example, an ultraviolet-ray-curing resin. By filling the space between the substrate 1, 8 with liquid crystals, a liquid crystal layer 10 is formed.

Common electrodes (not shown) made of, for example, indium tin oxide (ITO) having a light transmitting property are mounted on the counter substrate 8 so that the common electrodes match the liquid crystal layer 10. Color filters 11 of red (R), green (G), and blue (B) colors (base colors of displayed images) are provided at positions corresponding to pixel electrodes 5 which are mounted on the TFT substrate 1 to provide a color display. Further, a black matrix 12 for separating pixels 2 from each other is formed. The black matrix 12 can be formed not only on the counter substrate 8, but also on the TFT substrate 1.

As illustrated in FIG. 1, the pixels 2, scanning lines 3, and signal lines 4 are formed on the TFT substrate 1. The TFT substrate 1 includes a transparent insulating substrate made of, for example, glass on which the pixels 2 are formed in matrix form. Each pixel 2 is composed of three pixel electrodes 5 corresponding to R, G and B, respectively. The three pixel electrodes 5 are aligned in a direction corresponding to the up-and-down direction of a displayed image, for example, a building on the display. More specifically, as shown in FIG. 1, the three pixel electrodes 5 of a single pixel 2 are aligned in a longitudinal direction of the liquid crystal panel 21 (in the first direction that is the Y-axis direction in FIG. 1, and this direction is hereinafter referred to as the Y-axis direction in this embodiment).

Namely, the three pixel electrodes 5 are disposed at positions which are separated from the connected section 13 by the same distance. A TFT element 6 is connected to each of the pixel electrode 5 corresponding to R, G and B.

The TFT elements 6 are connected to the scanning lines 3 and signals lines 4 that are insulated from each other by insulating films 7. The scanning lines 3 are mounted along the Y-axis direction of the liquid crystal panel 21. The signal lines 4 are arranged in a direction orthogonal to the Y-axis direction (i.e., in the second direction that is the X-axis direction in FIG. 1, and this direction is hereinafter referred to as the X-axis direction). Namely, the positional relationship between the scanning lines 3 and the signal lines 4 are reversed, i.e., the positions of the scanning lines 3 and the signal lines 4 are exchanged in contrast to a typical active-matrix type liquid crystal display device. In other words, the positional relationship of the scanning lines and signal lines in a typical liquid crystal display device is rotated 90°.

When using the pixel electrodes 5 for a transmission type liquid crystal display device 20, they are formed by transparent conducting films such as ITO. On the other hand, when using the pixel electrodes 5 for a reflection type liquid crystal display device 20, they are formed by reflective conducting films such as aluminum (Al).

The TFT elements 6 are field-effect transistors using semiconducting thin films such as amorphous silicon (a-Si) and polysilicon (p-Si), and control the supply of electric signals to the pixel electrodes 5. Namely, the pixel electrodes 5 are driven by switching on and off the TFT elements 6 by signals from the scanning lines 3 and signal lines 4. As the materials for the scanning lines 3 and signal liens 4, it is possible to use metallic films such as tantalum (Ta), aluminum (Al), and molybdenum (Mo).

Since the liquid crystal display device 20 of this embodiment thus obtained has the wiring structure shown in FIG. 1, there is no need to arrange the signal lines 4 in the shape of a square bracket to almost enclose the pixel electrodes 5 like the wiring structure of a conventional liquid crystal display device. Consequently, it is possible to prevent the length of each signal lines 4 from becoming twice or more longer than a conventional line length.

Accordingly, this structure can reduce the delay of an image display signal as an electric signal to about a half of that in a conventional liquid crystal display device. The reduction of the delay of the image display signal is effective for preventing the delay of the speed of displaying a displayed image especially on a large-area liquid crystal display device. In particular, the reduction of the delay of the image display signal is very effective for a large-area display which is fabricated by connecting liquid crystal panels to each other like the one presented in this embodiment.

As a method which simply uses scanning lines 3 and signals lines 4 while retaining the arrangement of the pixel electrodes 5 to render the joint of the liquid crystal panels 21 less noticeable, it would be possible to use an interlayer insulating film formed on the TFT substrate 1 and form the scanning lines 3 and signal lines 4 with a multi-layer structure. However, this method requires an increased number of fabrication processes, makes the fabrication complicated, and increases the fabrication cost.

On the other hand, in the liquid crystal display device 20 of this embodiment, the scanning lines 3 and the signal lines 4 can be formed as a single layer on the TFT substrate 1. It is thus possible to prevent the fabrication processes from becoming complicated and an increase in the fabrication cost.

Moreover, in this wiring structure, the number of intersections where the scanning lines 3 and the signal lines 4 cross at right angles with each other through the insulating films 7 is less than that of the conventional example. More specifically, in the conventional wiring structure, there are six intersections of the lines in each pixel. In contrast, in the wiring structure shown in FIG. 1, the number of intersections is reduced to three. In short, the number of intersections of the lines is reduced to a half of that of the conventional structure. It is therefore possible to decrease the occurrence of defects due to an electrical short circuit to about a half, and further reduce the fabrication cost.

The above-mentioned black matrix 12 used in the liquid crystal display device 20 of this embodiment is a light absorbing film made of a material which absorbs light and shows black. The black matrix 12 functions as the light absorbing film because it prevents the incidence of light on the gap between the pixel electrodes 5 and on the area of the TFT elements 6. For example, when light passes through an area other than the pixel electrodes 5, the quality of a black display state degrades, and the contrast of the display is lowered. Furthermore, when the light is incident on the TFT elements 6, a leakage current is produced in a TFT channel due to light excitation, and the display quality is lowered. Such a lowering of the quality is prevented by the black matrix 12.

In addition, a gap to be the connected section (joint) 13 of the liquid crystal panels 21 is filled with the index adjusting material 14. The index adjusting material 14 is made of a material having substantially the same refractive index as that of the TFT substrate 1 and counter substrate 8 constituting each liquid crystal panel 21. The index adjusting material 14 can also be used as a sticking agent for fastening the liquid crystal panels 21 to the large transparent substrate 23.

Moreover, alignment films (not shown) for aligning liquid crystal molecules in a predetermined direction are formed on the inside surfaces of the TFT substrate 1 and counter substrate 8, that face the liquid crystal layer 10.

The alignment films are formed by achieving a homogeneous alignment by, for example, rubbing. As a result, the aligned direction of liquid crystal molecules of a nematic liquid crystal with positive dielectric anisotropy which is sealed in the gap between the TFT substrate 1 and the counter substrate 8 twist 90 degrees between the two pieces of the substrates 1, 8. Therefore, in the liquid crystal panel 21 of this embodiment, the liquid crystal molecules are driven in a twisted nematic (TN) display mode.

A large panel is fabricated by joining a pair of liquid crystal panels 21 of the above-mentioned structure and placing them on a plane surface of a piece of large transparent substrate 23. A pair of polarizing plates 24 are disposed on the entire surfaces of the front and back sides of the large panel, respectively, so that their polarization axes cross at right angles with each other. Thus, the liquid crystal display device 20 of this embodiment is fabricated.

In the liquid crystal display device 20 thus obtained, the connected section 13 of the liquid crystal panels 21 is filled with the index adjusting material 14 having substantially the same refractive index as that of the TFT substrate 1 and the counter substrate 8. It is therefore possible to prevent refraction and scattering of light due to the unevenness of the side faces of the substrates 8 in the connected section 13. Consequently, it is possible to provide a natural displayed image with a less noticeable joint in the display.

As described above, the index adjusting material 14 can be used as a sticking agent in fastening the liquid crystal panels 21 to the large transparent substrate 23. In this case, however, there is a possibility that reflection of light occurs on the interface between the large transparent substrate 23 and the counter substrate 8. As a result, since the contrast of the display is lowered, it is preferred to use a resin having the same refractive index as that of the counter substrate 8 and the large transparent substrate 23 for the index adjusting material 14. Consequently, a natural displayed image with a much less noticeable joint is obtained.

In general, in a multi-display type liquid crystal display device fabricated by simply joining active-matrix type liquid crystal panels using TFT elements together, light from a back light leaks through a gap which is produced in the joint of the liquid crystal panels. As a result, the joint becomes noticeable in the display of the liquid crystal display device.

However, in the liquid crystal display device 20 of this embodiment, the polarizing plates 24 are disposed on the entire surfaces of the front and back sides of the above-mentioned large panel, respectively, so that their polarization axes cross at right angles with each other. When the polarization axes of the polarizing plates 24 cross at right angles with each other, even if light leaks through the connected section 13, the display exhibits black due to the crossed nicol state of the polarizing plates 24.

Consequently, when the liquid crystal display device 20 is viewed from an observer positioned substantially in front of the liquid crystal display device 20, the light leaks from the connected section 13 of the liquid crystal panels 21 realizes a completely black state due to the crossed nicol state of the polarizing plates 24. Accordingly, the joint in the display becomes less noticeable.

Here, it is difficult to make the refractive index of the index adjusting material 14 completely equal to that of the substrates constituting the liquid crystal panels 21, namely, the TFT substrate 1, counter substrate 8 and large transparent substrate 23, in the entire range of visible light. Therefore, slight refraction and scattering of light occur in the connected section 13. As a result, although the joint is less noticeable, the joint is recognized to some degrees by a viewer.

However, in the pixel arrangement of the liquid crystal display device 20, as illustrated in FIG. 3, three pixel electrodes 5 corresponding to R, G, B color filters 11 are arranged in the RGB order along the Y-axis direction of FIG. 3 so that the pixel electrodes 5 are separated from the connected section 13 by substantially the same distance in each of the pixels 2 arranged in a matrix form on the TFT substrates 1 of the two pieces of the liquid crystal panels 21.

In this arrangement, even when the light transmitting through the color filters 11 corresponding to the pixels 2 located near the connected section 13 is affected by scattering and refraction of light in the connected section 13, the degree of color modulation is substantially uniform in the respective pixels 2. Therefore, the color balance of light is not changed by the light from a direction oblique to the pixel 2 near the connected section 13, thereby preventing the formation of regions of different color tones in the connected section 13. It is thus possible to produce the effect of rendering the joint in the display less noticeable.

Figure 4:
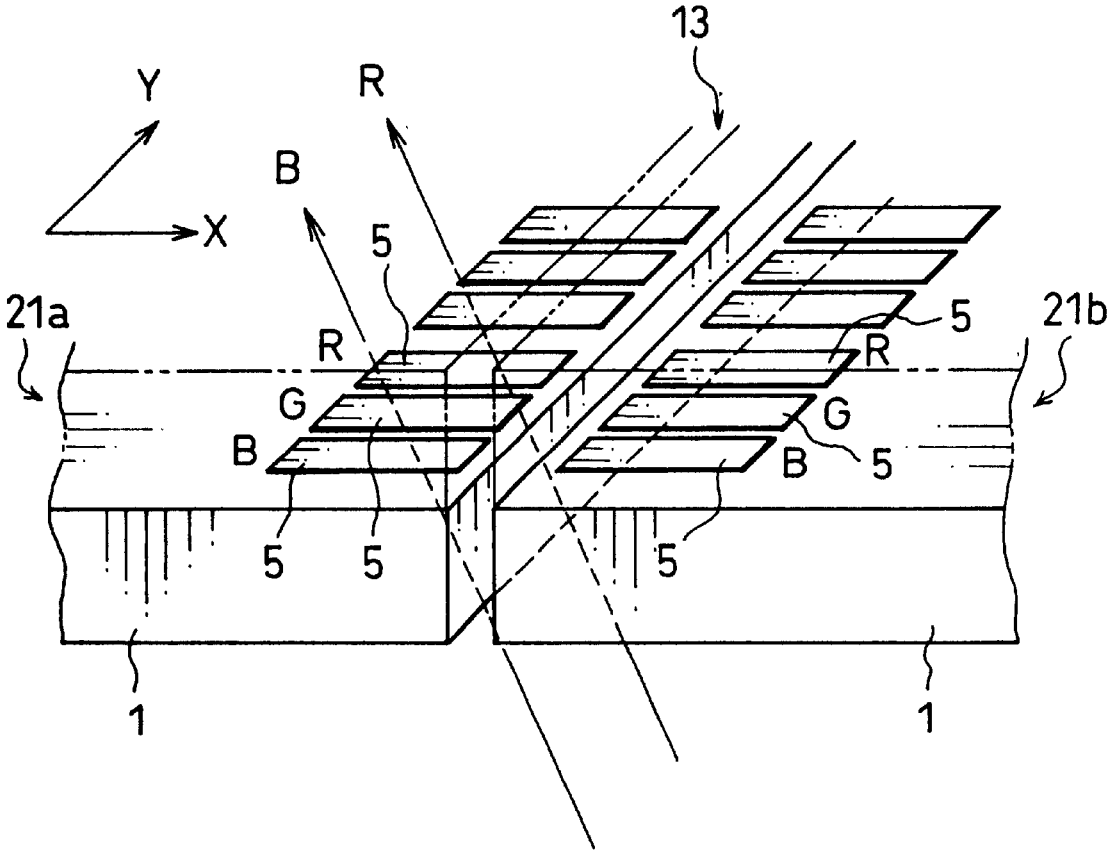
FIG. 4 is an explanatory view showing a state of transmitted light in the vicinity of the joint of liquid crystal panels of the liquid crystal display device shown in FIG. 2.

More specifically, if the two pieces of the liquid crystal panels 21 are denoted as 21*a* and 21*b*, as shown in FIG. 4, the pixel electrodes 5 corresponding to R, G and B are disposed at positions which are substantially equally separated from the connected section 13. In this state, suppose that transmitted light R and transmitted light B travel toward the pixel electrodes 5 on the liquid crystal panel 21*a* from a downward direction of the liquid crystal panel 21*b*, both of the transmitted light R, B pass through the color filters 11 (not shown in FIG. 4) formed on each of the pixel electrodes 5 after passing through the connected section 13 of the liquid crystal panels 21*a*, 21*b*. In other words, the light transmitted through the R, G, B color filters 11 are affected by the connected section 13 of the liquid crystal panels 21*a*, 21*b* to the same degree.

Namely, light which is emitted from the liquid crystal panel 21*b* side to pass through the liquid crystal panel 21*a* via the connected section 13 passes through the respective color filters 11 in the same manner. Consequently, when light, which is emitted from the liquid crystal panel 21*b* side to pass the liquid crystal panel 21*a* via the index adjusting member 14, passes through any of the pixels 2 adjacent to the connected section 13, the index adjusting member 14 can cause the pixel electrodes 5 corresponding to the respective colors of the pixels 2 to have uniform color modulation. Therefore, even in a large-area liquid crystal display device fabricated by joining a plurality of liquid crystal panels 21, it is possible to prevent color distortion at the pixels 2 located near the connected section 13, and display images of uniform quality over the entire display.

Moreover, in general, when joining a plurality of liquid crystal panels together, it is very difficult to join them without making a difference in level due to a variation in glass thickness and warpage of the liquid crystal panels. Furthermore, when fabricating the liquid crystal panels, the liquid crystal panels have scratches such as chipping at their edges. If there is a difference in level at the joint of such liquid crystal panels or are scratches at the edges of the liquid crystal panels, the joint becomes noticeable because light is scattered at the defective section.

However, in the liquid crystal display device 20 of this embodiment, as shown in FIG. 2, two pieces of liquid crystal panels 21 are fastened to one piece of large transparent substrate 23 with the index adjusting material 14. Therefore, when a viewer sees a displayed image from the large transparent substrate 23 side, the difference in level and scratches caused by a variation in glass thickness and warpage of the liquid crystal panels 21 do not appear on the surface of the liquid crystal display device 20. It is thus possible to obtain high-quality displayed images on a natural large-area display with a much less noticeable joint.

Additionally, the large transparent substrate 23 functions as a reinforcing plate in a large-area liquid crystal display device 20 fabricated by joining the liquid crystal panels 21 together. Hence, the liquid crystal display device 20 has improved shock resistance. Namely, the liquid crystal display device 20 of this embodiment enables a further increase in the size of the display and provide a natural displayed image without a noticeable joint.

As described above, in the liquid crystal display device 20, it is possible to render the connected section 13 of the two pieces of the liquid crystal panels 21 less noticeable. As a result, the display quality of the liquid crystal display device 20 is improved compared to the conventional structure.

In this embodiment, two pieces of liquid crystal panels are connected to each other. However, for example, it is possible to align three pieces of liquid crystal panels in a lateral direction and connect them to each other. By connecting liquid crystal panels in a lateral direction to fabricate a wider display, it is possible to meet a recent trend towards wide-screen television sets.

Next, the following description will explain the method of driving the liquid crystal display device 20.

In the liquid crystal display device of this embodiment, as described above, the scanning lines are arranged along the Y-axis direction. It is therefore necessary to perform line-sequential scanning from the left to the right or from the right to the left of the display along the X-axis direction shown in FIG. 1. In a conventional liquid crystal display device, image data are arranged so that an image is displayed by performing line-sequential scanning in the Y-axis direction, i.e., the up-and-down direction of a displayed image to be provided on the display. Therefore, in this embodiment, it is necessary to convert the image data for the conventional line-sequential scanning in the Y-axis direction into image data for line-sequential scanning in the X-axis direction.

Figure 15:
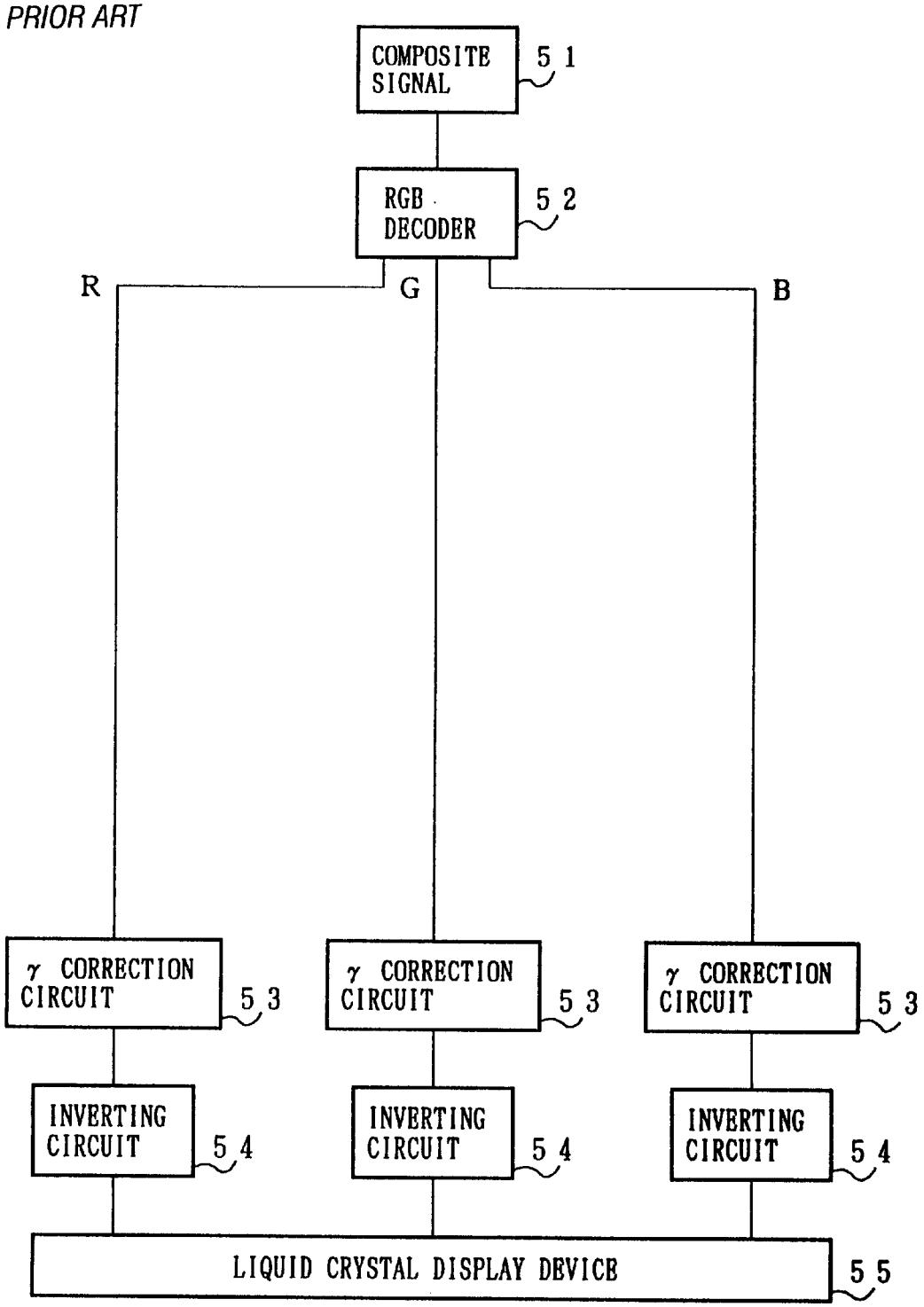
FIG. 15 PRIOR ART
FIG. 15 is a block diagram of a drive method of the conventional liquid crystal display device.

In the conventional image data processing, as shown in FIG. 15, a composite signal 51 representing a color display data is input to a liquid crystal display device. The input composite signal 51 is decomposed into color image data corresponding to R, G, B by a RGB decoder 52. The image data of the respective colors thus decomposed are subjected to gamma correction 53 and inversion 54. Thereafter, the resultant image data are subjected line-sequential scanning in the Y-axis direction, and then displayed as an image on a liquid crystal display device 55.

Figure 5:
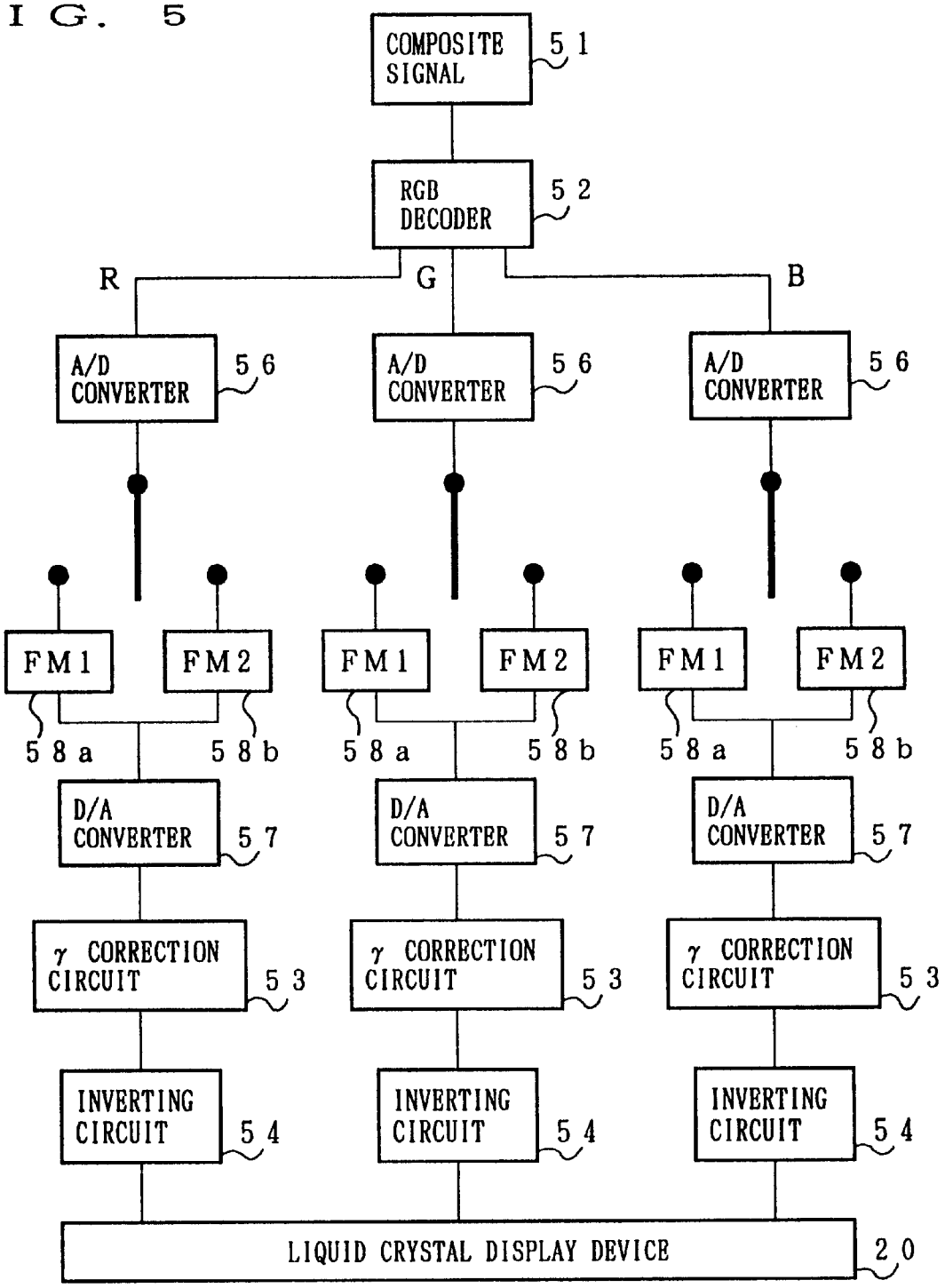
FIG. 5 is a block diagram of a drive circuit which drives the liquid crystal display device.

Compared to the conventional image data processing, in the liquid crystal display device 20 of this embodiment, as shown in FIG. 5, two frame memories (data storage means shown as "FM" in FIGS. 5 to 7) 58*a*, 58*b* for changing an arrangement of the color image data within a frame are provided for each color of the image data corresponding to R, G, and B. Namely, six frame memories are provided in total for a set of color image data. The frame memory stores image data for performing line sequential scanning in the Y-axis direction, and converts the arrangement of the image data for carrying out line sequential scanning in the X-axis direction. In this embodiment, the image data to be stored/output are color image data decomposed into R, G and B data mentioned above.

Therefore, a RGB decoder 52 for decomposing the image data into R, G and B image data is provided. Moreover, an A/D converter 56 for converting color image data to be stored in the frame memories 58*a*, 58*b* into digital form, and a D/A convertor 57 for converting the image data output from the frame memories 58*a*, 58*b* into analog signals are provided for each of the colors R, G, and B.

The process of data conversion will be explained in the sequential order. First, the composite signal 51 input to the liquid crystal displayed device is decomposed into color image data corresponding to R, G and B by the RGB decoder 52. First, the color image data of R (red) (hereinafter referred to as the "R data") is explained. The R data obtained by decomposing the image data is converted into digital form by the A/D converter 56, and then stored in the frame memories 58*a*, 58*b*.

Figure 6:
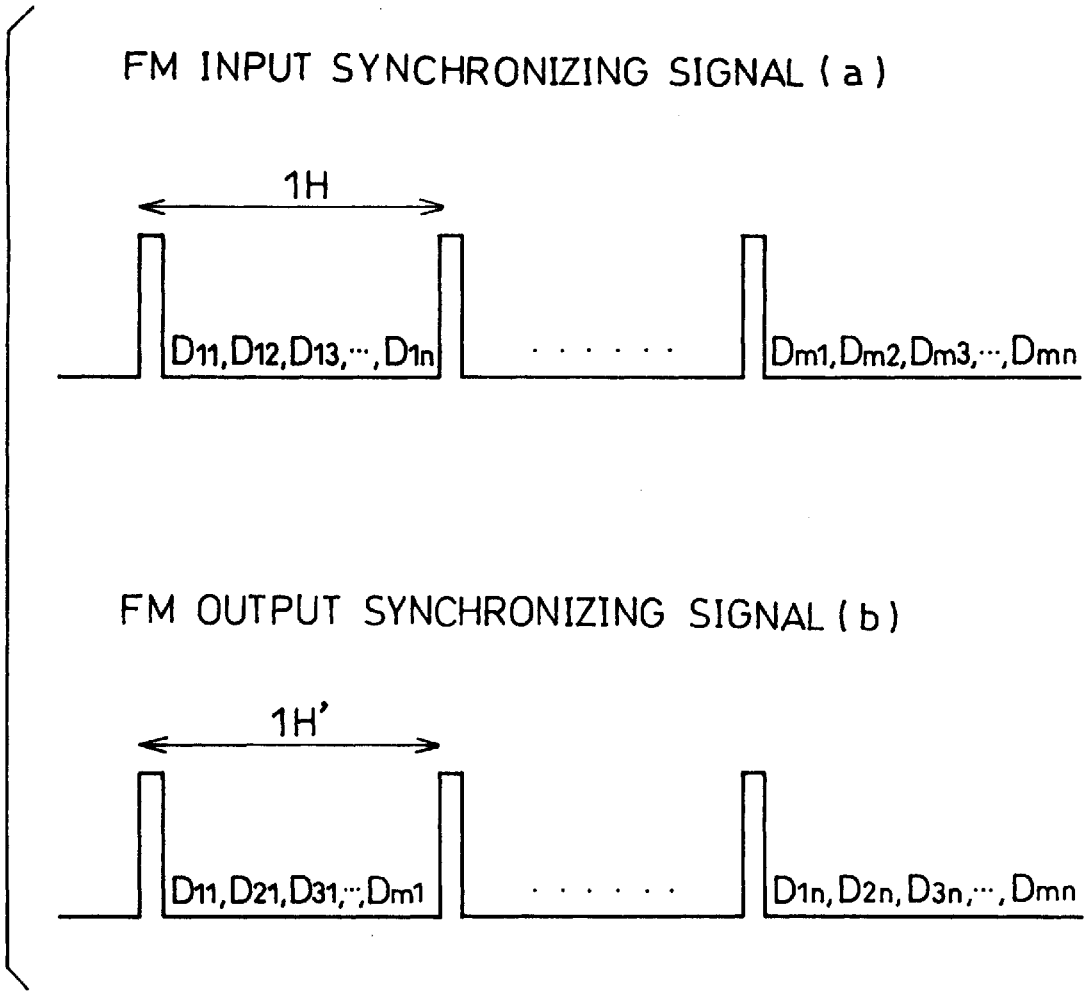
FIG. 6 is a view showing the sequence of the input and output of color image data with respect to frame memories according to the drive method of FIG. 5.

The frame memories 58*a*, 58*b* are segmented by the addresses of n rows and m columns according to the size of the liquid crystal panel. As shown in FIG. 6, rows of R data, such as [D11, D12, D13, . . . , D1*n*], [D21, D22, D23, . . . , D2*n*], . . . , and [Dm1, Dm2, Dm3, . . . , Dmn] (here "D" represents image data), are stored in this order so that a row of the R data are stored in one pulse spacing according to an input synchronizing signal (a) of pulse spacing 1H.

During output, as shown in FIG. 6, columns of the R data arranged in order, such as [D11, D21, D31, . . . , Dm1], [D12, D22, D32, . . . , Dm2], . . . , and [D1*n*, D2*n*, D3*n*, . . . , Dmn], are output in this order so that a column of the R data are output in one pulse spacing according to an output synchronizing signal (b) of pulse spacing 1H'.

Moreover, in order to enable simultaneous storage and output of the R data, two types of memories, namely, a first memory that is a first storage means (shown as FM1 in FIGS. 5 and 7) and a second memory that is a second storage means (indicated as FM2 in FIGS. 5 and 7) are used as the frame memories 58*a*, 58*b*, respectively. The first memory 58*a* and second memory 58*b* are controlled by the input and output synchronizing signals shown in FIG. 7 so that they are activated alternately.

Figure 7:
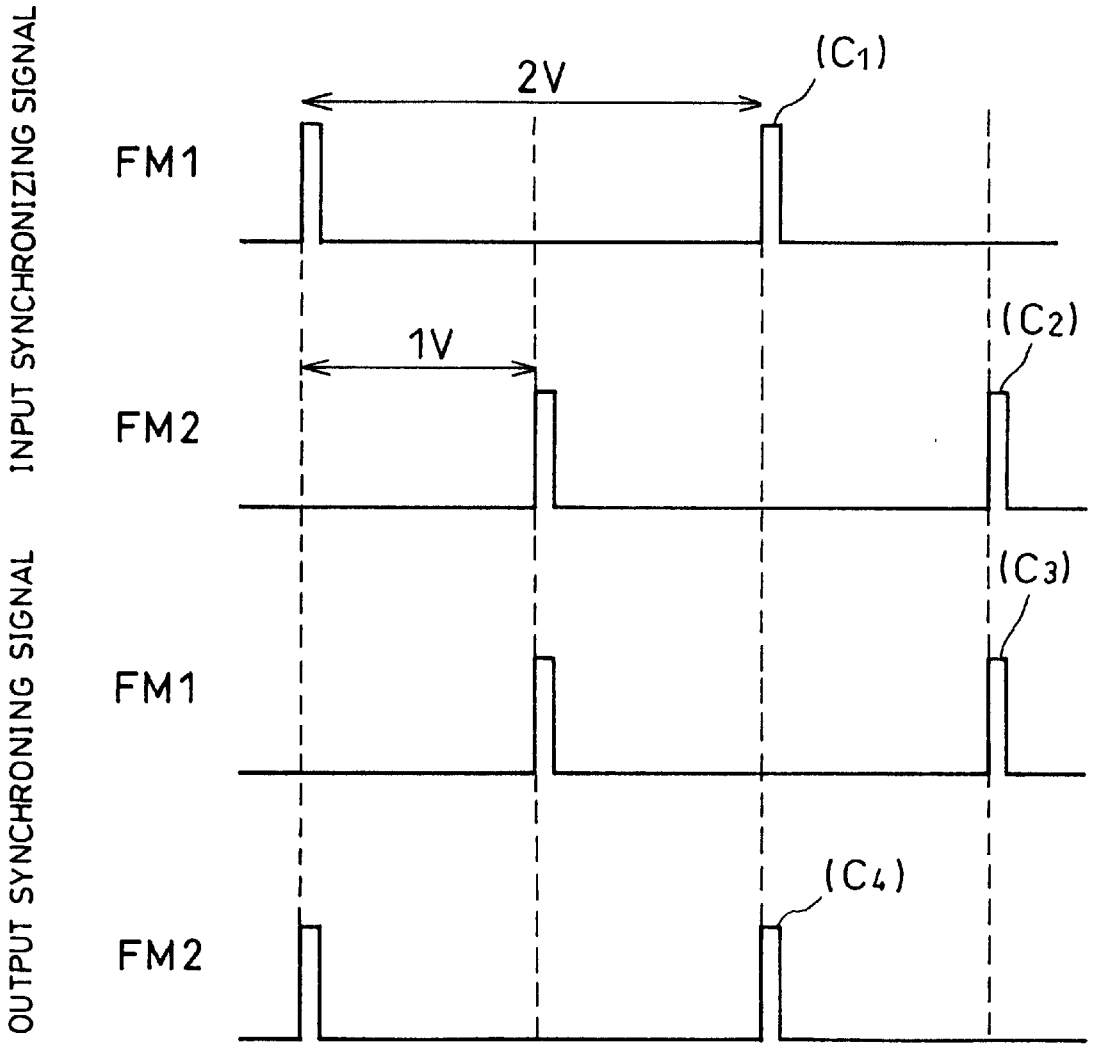
FIG. 7 is a view showing input and output synchronizing signals for switching memories between a first frame memory and a second frame memory according to the drive method shown in FIG. 5.

More specifically, as shown in FIG. 7, when the first memory 58*a* is storing the R data according to an input synchronizing signal ($c_1$), the second memory 58*b* outputs the R data according to an output synchronizing signal ($c_4$). Next, when the second memory 58*b* starts storing the R data according to an output synchronizing signal ($c_2$), the first memory 58*a* outputs the R data according to an output synchronizing signal ($c_3$).

Therefore, for example, as shown in FIG. 7, the input and output synchronizing signals have the same pulse spacing 2V and the same frequency. However, the input and output synchronizing signals for controlling the data storage to the first memory 58*a* and the data output from the second memory 58*b* and the input and output synchronizing signals for controlling the data storage to the second memory 58*b* and the data output from the first memory 58*a* shift from each other by a half of the pulse spacing, i.e., 1V. Here, in order to prevent distortion of displayed images, the storage and output of color image data of R, G and B must be performed according to the above-mentioned input and output synchronizing signals.

By arranging the frame memories 58*a* and 58*b* to be activated in the above-mentioned manner, the R data can be converted in each frame. Subsequently, the R data output from the frame memories 58*a*, 58*b* are converted into analog form by the D/A convertor 57 as shown in FIG. 5, and then subjected to a gumma correction in a gumma-correction circuit 53 and an inversion in an inverting circuit 54. The G (green) and B (blue) data are subjected to the same data conversion as the R data. Thereafter, the converted color image data of R, G and B are displayed as a displayed image on the liquid crystal display device 20.

As a result, the liquid crystal display device 20 of this embodiment in which the scanning lines 3 and signals lines 4 are arranged as shown in FIG. 1 can display an image like the conventional liquid crystal display device. It is therefore possible to make the joint of the panels less noticeable and improve the quality of the displayed image more easily.

The driving method of the liquid crystal display device 20 of this embodiment is not limited to the above-mentioned method. For example, when inputting the image data through a personal computer, it is possible to input digital image data directly to the frame memories instead of using the A/D converter. Moreover, it is possible to directly perform a data conversion by a personal computer using a software instead of the above-mentioned data conversion process. The number of frame memories is not particularly restricted. In addition, it is not necessarily to decompose the image data into R, G and B data, and the form of the image data is not particularly restricted if the image data is efficiently converted.

Furthermore, in this embodiment, as described above, an active-matrix type liquid crystal panel using TFT elements is used as the liquid crystal panel. However, it is also possible to use active-matrix type liquid crystal display panel using diodes (MIM, metal insulator metal). As liquid crystal panels other than those mentioned above, a duty driving type liquid crystal panel is effective. However, active-matrix type liquid crystal panels are preferred because they can provide high-quality displayed images with reduced cross talk.

Embodiment 2

The following description will explain another embodiment of the present invention with reference to FIGS. 8 to 11. This embodiment explains a liquid crystal display device providing a color large-area display, which is fabricated by connecting two pieces of liquid crystal panels adjacently like Embodiment 1 mentioned above. However, this embodiment does not limit the present invention.

Figure 8:
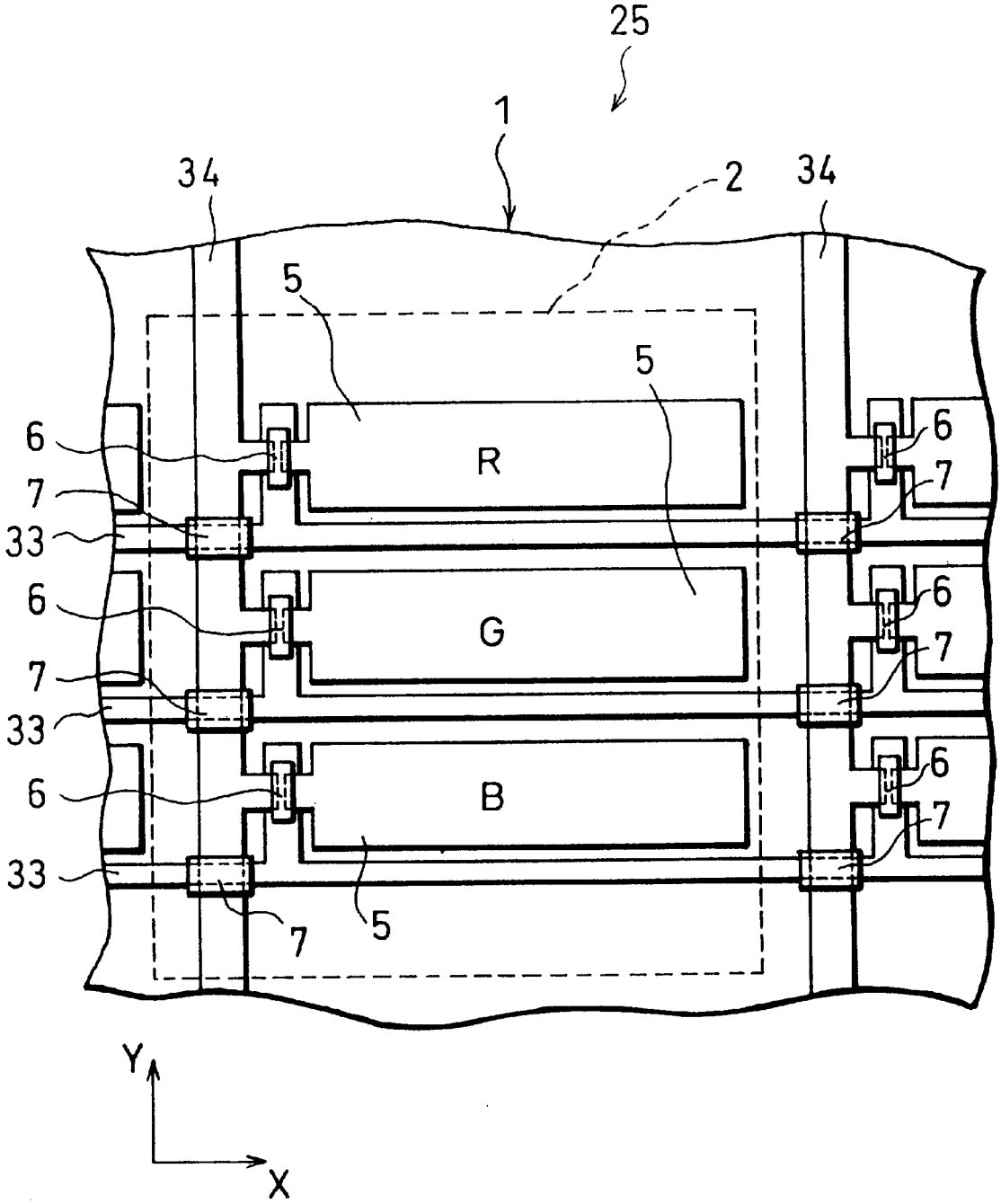
FIG. 8 is a schematic plan view showing in detail a pixel section of a liquid crystal display device according to another embodiment of the present invention.

As illustrated in FIG. 8, an active-matrix type liquid crystal display device 25 of this embodiment is constructed in the same manner as in Embodiment 1 except for the wiring of the scanning lines 33 and signal lines 34 connected to the pixel electrodes 5.

More specifically, the pixels 2 are formed in matrix form on the TFT substrate 1 made of a transparent insulating substrate, and three pixel electrodes 5 of R, G and B are formed in a line in each pixel 2. In this case, the pixel apertures of the three pixels 5 are aligned in the Y-axis direction of the liquid crystal panel. Namely, like the structure shown in FIG. 3, the three pixels 5 are disposed at positions which are separated from the connected section 13 by the same distance. A TFT element 6 is connected to each of the pixel electrodes 5 corresponding to R, G and B.

The TFT elements 6 are connected to the scanning lines 33 and signals lines 34 which are insulated from each other by insulating films 7. The scanning lines 33 are mounted along the X-axis direction, and the signal lines 34 are arranged in the Y-axis direction. Namely, the wiring of the scanning lines 33 and signal lines 34 is similar to that of a typical active-matrix type liquid crystal display device.

In a conventional arrangement, a scanning line 33 is formed for each pixel 2. Whereas in this embodiment, a scanning line 33 is provided for each of the pixel electrodes 5 corresponding to R, G and B. Namely, three scanning lines 33 are provided for each pixel 2. Moreover, in the conventional arrangement, a signal line 34 is disposed for each of the pixel electrodes 34 corresponding to R, G and B. On the other hand, in this embodiment, a signal line 34 is provided for each pixel 2.

Next, the following description will explain the method of driving the liquid crystal display device 25 of this embodiment using the above-mentioned TFT substrate 1.

As described above, in the liquid crystal display device 25 of this embodiment, the signal lines 34 are arranged along the Y-axis direction of the display, and a scanning line 33 is provided for each of the pixel electrodes 5 corresponding to R, G and B. Therefore, line-sequential scanning of the display needs to be performed with respect to each of the pixel electrodes 5 corresponding to R, G and B constituting the pixels 2, instead of the pixels 2.

Figure 9:
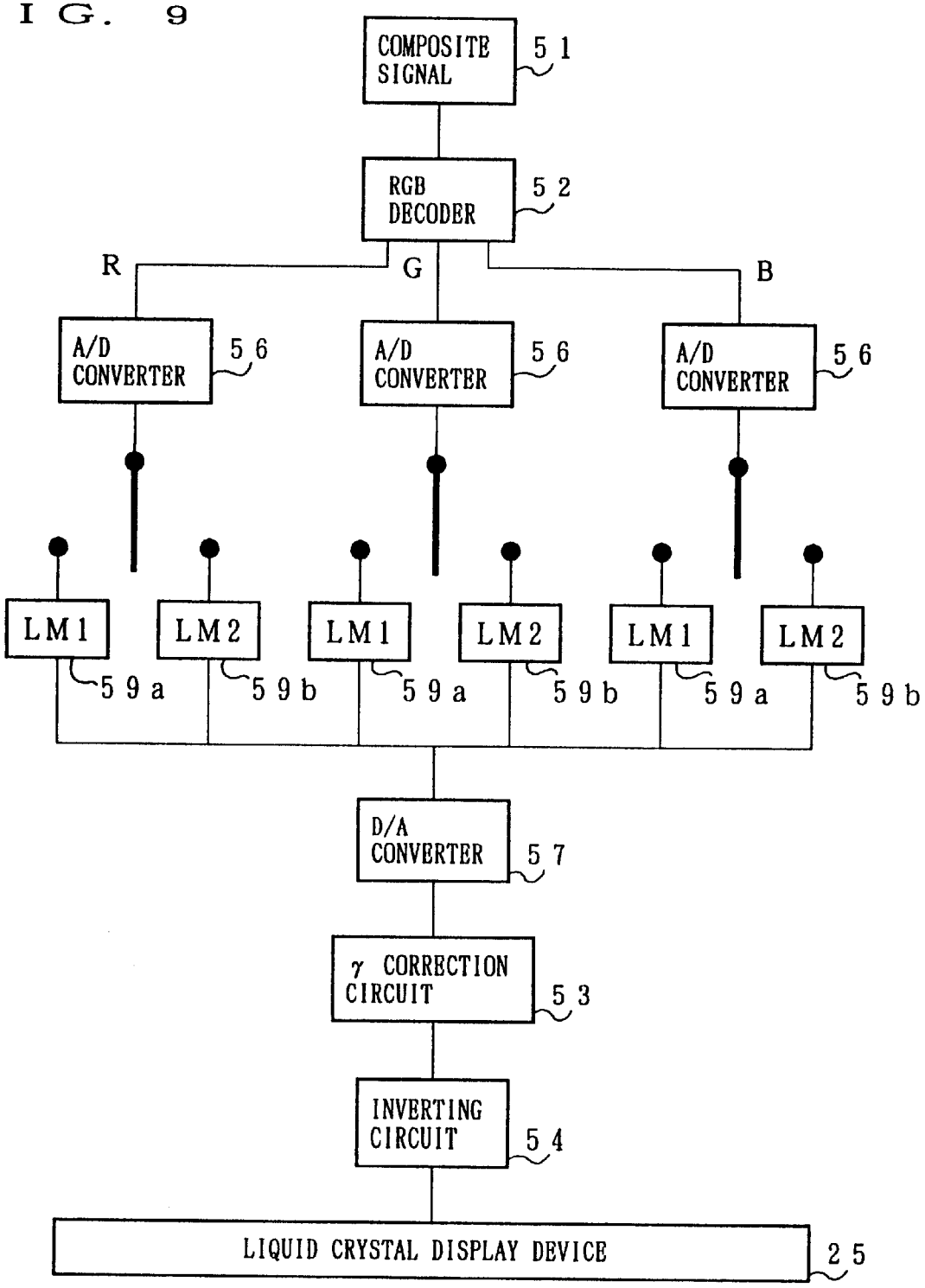
FIG. 9 is a block diagram of a drive circuit which drives the liquid crystal display device of FIG. 8.

In order to meet the above-mentioned conditions, compared to the conventional image data processing shown in FIG. 15, two line memories (data storage means, indicated as "LM" in FIGS. 9 to 11) 59*a*, 59*b* for changing the arrangement of image data are additionally provided for each color of the color image data as shown in FIG. 9. Namely, six line memories are provided in total for a set of image data. The line memories store the color image data, and change the arrangement of the image data so as to perform line sequential scanning of the pixel electrodes 5 in the Y-axis direction.

In this structure, therefore, the RGB decoder 52 for decomposing the image data into color image data of R, G and B is provided. Furthermore, an A/D converter 56 for converting color image data to be stored in the line memories 59*a*, 59*b* into digital form is mounted with respect to each of the image data corresponding to R, G and B. In addition, a D/A convertor 57 for converting the color image data of R, G and B which are output independently from each of the line memories 59*a*, 59*b* into analog form are provided.

The process of data conversion will be explained in the sequential order. First, the composite signal 51 input to the liquid crystal display device 25 is decomposed into image data corresponding to R, G and B by the RGB decoder 52. Each of the resultant color image data of the respective colors is converted into digital form by the A/D converter 56, stored temporarily in the line memories 59*a*, 59*b*, and then output.

Like the frame memories 58*a*, 58*b* of Embodiment 1, in order to enable simultaneous storage and output of the color image data, two types of memories, namely, a first memory that is a first storage means (shown as LM1 in FIGS. 9 to 11) and a second memory that is a second storage means (indicated as LM2 in FIGS. 9 to 11) are used as the line memories 59*a*, 59*b*, respectively. The first memory 59*a* and second memory 59*b* are controlled by the input and output synchronizing signals shown in FIG. 10 so that they are activated alternately. More specifically, when the first memory 59*a* is storing color image data, the second memory 59*b* outputs color image data. When the second memory 59*b* starts storing image data, the first memory 59*a* outputs color image data.

Figure 10:
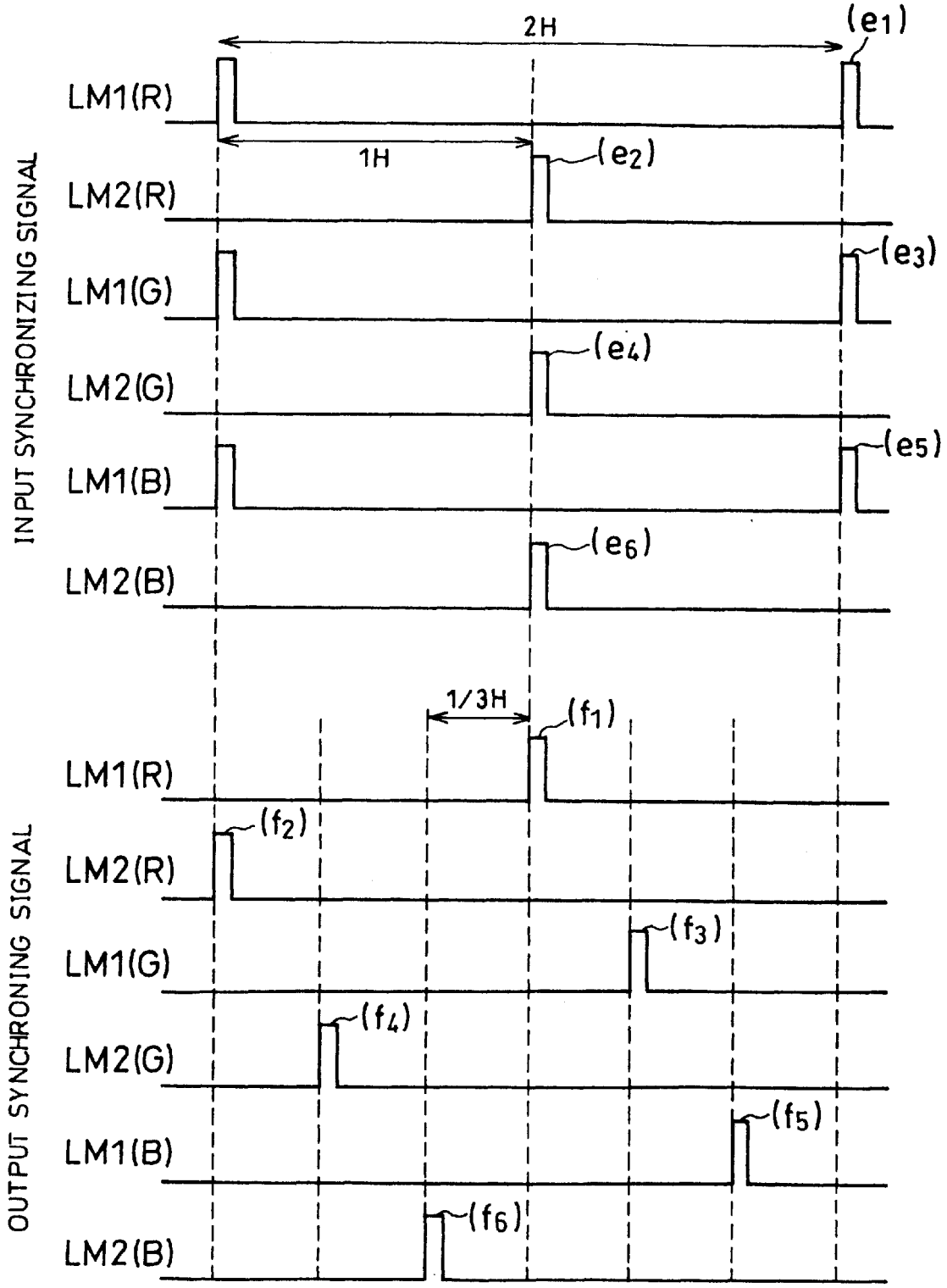
FIG. 10 is a view showing the sequence of the input and output of color image data with respect to line memories according to the drive method shown in FIG. 9.

At this time, as shown in FIG. 10, by increasing the frequency of the output synchronizing signal three times more than that of the input synchronizing signal with respect to the line memories 59*a*, 59*b*, the color image data are output in a period of time which is one third of the storage time. More specifically, when a period of time between two consecutive input/output synchronizing signals is 2H, the first memory 59*a* and the second memory 59*b* are alternately activated at intervals of a half of the period, i.e., 1H, to store color image data, and the first memory 59*a* and the second memory 59*b* are alternately activated at intervals of ⅓H to output the color image data.

In the line memories 59*a* and 59*b*, it is necessary to synchronize a period in which the R, G and B color image data whose output time is respectively shortened to one third of the storage time are output in the RGB order with one scanning period. Namely, in this embodiment, the period of time in which the R, G and B color image data are stored concurrently in the line memories 59*a*, 59*b* (1H) needs to be the same as a period of time in which all of these stored color image data are output.

It is therefore necessary to adjust the input and output timing of the line memories 59*a* and 59*b*, and repeatedly output the image data of R, G and B signals stored concurrently in the RGB order according to the input and output synchronizing signals shown in FIG. 10.

Specifically, as shown in FIG. 10, in a period in which the first memories 59*a* are storing the respective color image data of R, G and B signals concurrently according to input synchronizing signals ($e_1$), ($e_3$) and ($e_5$), the second memories 59*b* sequentially output each of image data, whose output time is shortened to one third of the storage time, in the RGB order according to output synchronizing signals ($f_2$), ($f_4$) and ($f_6$). Next, when the second memories 59*b* start storing the color image data of R, G and B signals concurrently according to input synchronizing signals ($e_2$), ($e_4$) and ($e_6$), the first memories 59*a* sequentially output each of the image data, whose output time is shortened to one third of the storage time, in the RGB order according to output synchronizing signals ($f_1$), ($f_3$) and ($f_5$).

Here, in order to prevent distortion of displayed images, the storage and output of color image data must be performed according to the above-mentioned input and output synchronizing signals.

Figure 11:
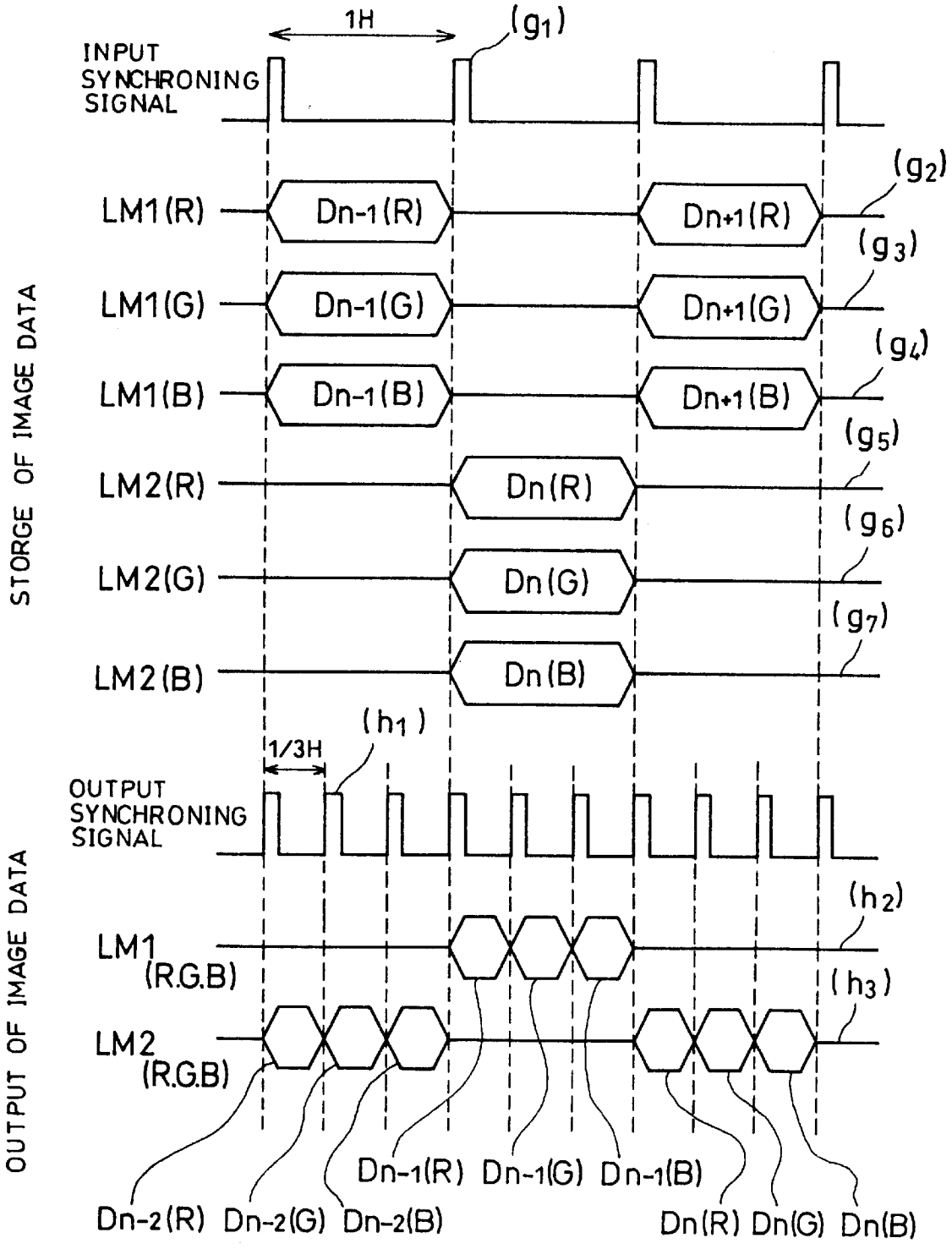
FIG. 11 is a time chart showing the input and output of color image data with respect to the line memories according to the drive method of FIG. 9.

The color image data (indicated as D) are stored and output by the line memories 59*a*, 59*b* controlled by the input and output synchronizing signals as shown in FIG. 11. Color image data [Dn−1] (R, G and B color image data are represented by ($g_2$), ($g_3$) and ($g_4$), respectively in FIG. 11) are stored concurrently according to the input synchronizing signal shown in FIG. 10 (the input synchronizing signal shown in ($g_1$) in FIG. 11) in a period of the pulse spacing 1H of the signal as shown in FIG. 11. At the same time, as shown in FIG. 11, color image data [Dn−2] (a set of the R, G and B color image data indicated by ($h_3$) in FIG. 11) are individually output in the RGB order repeatedly from the second memory 59*b* at intervals of pulse spacing ⅓H which is shortened to one third of the storage time according to the output synchronizing signal shown in FIG. 10 (the output synchronizing signal ($h_1$) in FIG. 11).

Namely, a period of time in which of each of the color image data [Dn−1] is stored in the first memory 59*a* and a period of time in which the color image data [Dn−2] are sequentially output in the RGB order from the second memory 59*b* are the same.

When the storage of the color image data [Dn−1] to the first memory 59*a* and the output of the color image data [Dn−2] from the second memory 59*b* are completed at the same time, the color image data [Dn] (R, G and B color image data are represented by ($g_5$), ($g_6$) and ($g_7$), respectively in FIG. 11) are stored concurrently in the second memories 59*b* according to the input synchronizing signal shown in FIG. 10 (the input synchronizing signal ($g_1$) in FIG. 11). At this time, as shown in ($h_2$), the color image data [Dn−1] (a set of the R, G and B color image data indicated by ($h_2$) in FIG. 11) which were stored previously are individually output repeatedly in the RGB order repeatedly from the first memories 59*a* within a period of time that is shortened to one third of the storage time according to the output synchronizing signal shown in FIG. 10 (the output synchronizing signal ($h_1$) in FIG. 11).

When the storage of the color image data [Dn] and the output of the color image data [Dn−1] are completed, the first memories 59*a* concurrently store color image data [Dn+1] (R, G and B color image data represented by ($g_2$), ($g_3$) and ($g_4$), respectively in FIG. 11) again according to the input synchronizing signal shown in FIG. 10 (the input synchronizing signal ($g_1$) in FIG. 11). At the same time, the color image data [Dn] (a set of the R, G and B color image data indicated by ($h_3$) in FIG. 11) which were stored previously are individually output in the RGB order from the second memory 59*b* according to the output synchronizing signal shown in FIG. 10 (the output synchronizing signal ($h_1$) in FIG. 11). By repeating such storage and output processes, it is possible to perform line scanning of each of the colors, R, G and B.

Subsequently, the color image data output from the line memories 59*a*, 59*b* are converted into analog signals by the D/A convertor 57, and then subjected to a gamma correction in the gumma-correction circuit 53 and an inversion in the inverting circuit 54. Thereafter, line sequential scanning is performed in the Y-axis direction of the display with respect to the pixel electrodes 5, and an image is displayed. Thus, even on the liquid crystal display device 25 of this embodiment having the wiring of the scanning lines 33 and signal lines 34 shown in FIG. 8, it is possible to display an image like a conventional liquid crystal display device.

Namely, the driving method of the liquid crystal display device includes a first step of decomposing image data of each pixel, for providing a color display, into a plurality of color image data corresponding to each pixel electrode, a second step of temporarily storing the decomposed color image data, and a third step of outputting the color image data arranged in a predetermined order.

In the second step, the color image data are stored concurrently. In the third step, the color image data arranged in a predetermined order are output so as to perform line sequential scanning for each of pixel electrode. At this time, the output time of each color image data is shortened to the storage time of the color image data so that the storage of the image data in the second step is synchronized with the output of the color image data in the third step.

As a result, the storage time of the color image data becomes the same as the output time. It is therefore possible to perform the storage of an array of color image data and the output of a different array of color image data simultaneously. Consequently, it is possible to display an image like a conventional liquid crystal display device.

The method for driving the liquid crystal display device of this embodiment is not necessarily limited to the one mentioned above. For example, when inputting the image data through a personal computer, go it is possible to input digital image data directly to the line memories instead of using the A/D converter. Moreover, it is possible to directly perform a data conversion by a personal computer using a software instead of the above-mentioned data conversion process.

In addition, in this embodiment, as described above, an active-matrix type liquid crystal panel including TFT elements is used as the liquid crystal display panel. However, it is also possible to use active-matrix type liquid crystal panel using diodes (MIM, metal insulator metal). As liquid crystal panels other than those of active-matrix type, a duty driving type liquid crystal display panel is effective. However, active-matrix type liquid crystal display panels are preferred because they can provide high-quality displayed images with reduced cross talk.

By the way, in Japanese Publication of Unexamined Patent Application No. 122769/1997 (Tokukaihei 8-122769), the present inventor proposed a method of rendering the joint in the display less noticeable by filling the joint of the liquid crystal panels with an index adjusting material having substantially the same refractive index as that of panel substrates constituting the liquid crystal panels.

Figure 12:
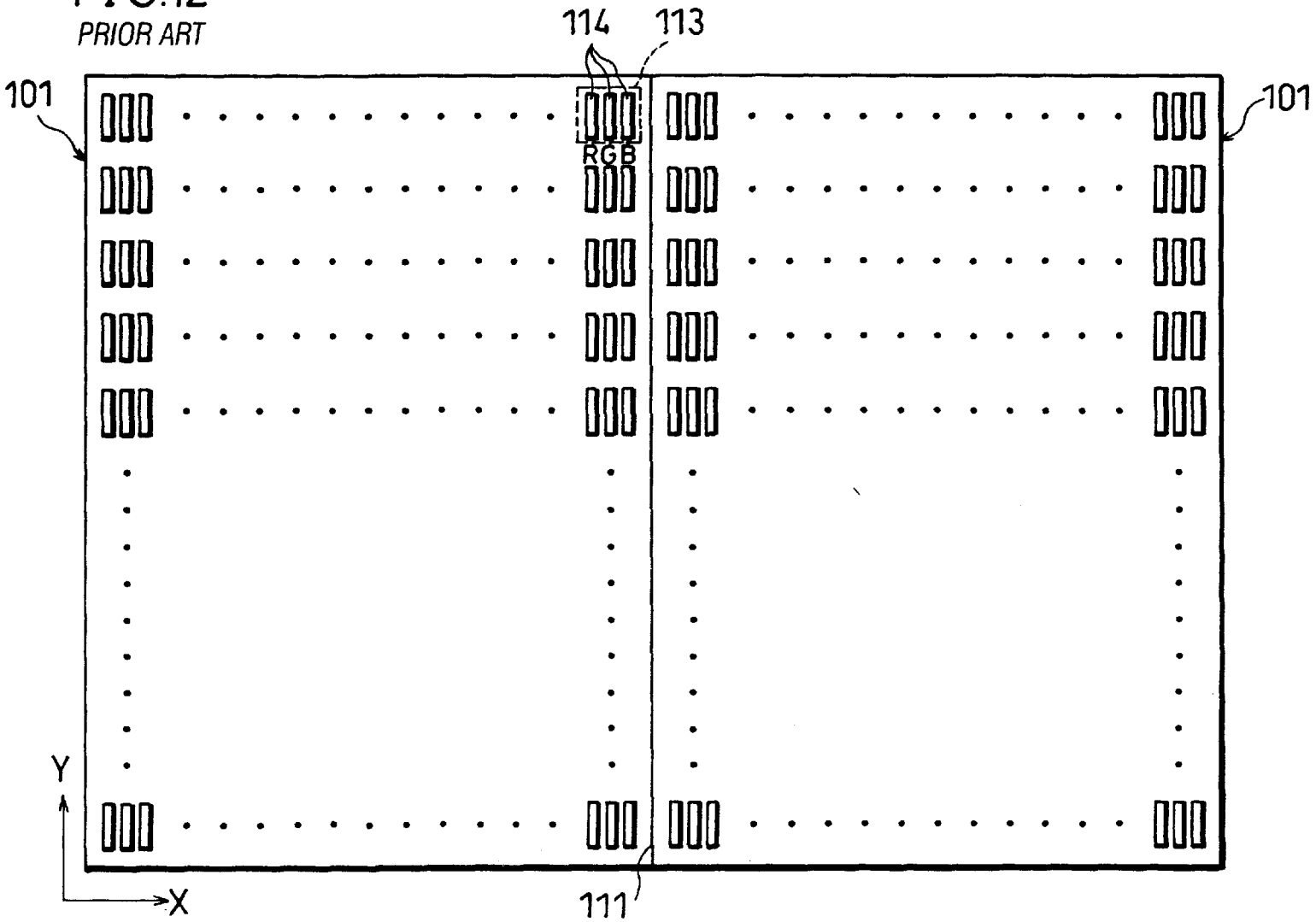
FIG.12 PRIOR ART
FIG. 12 is a schematic plan view of a conventional liquid crystal display device.
Figure 13:
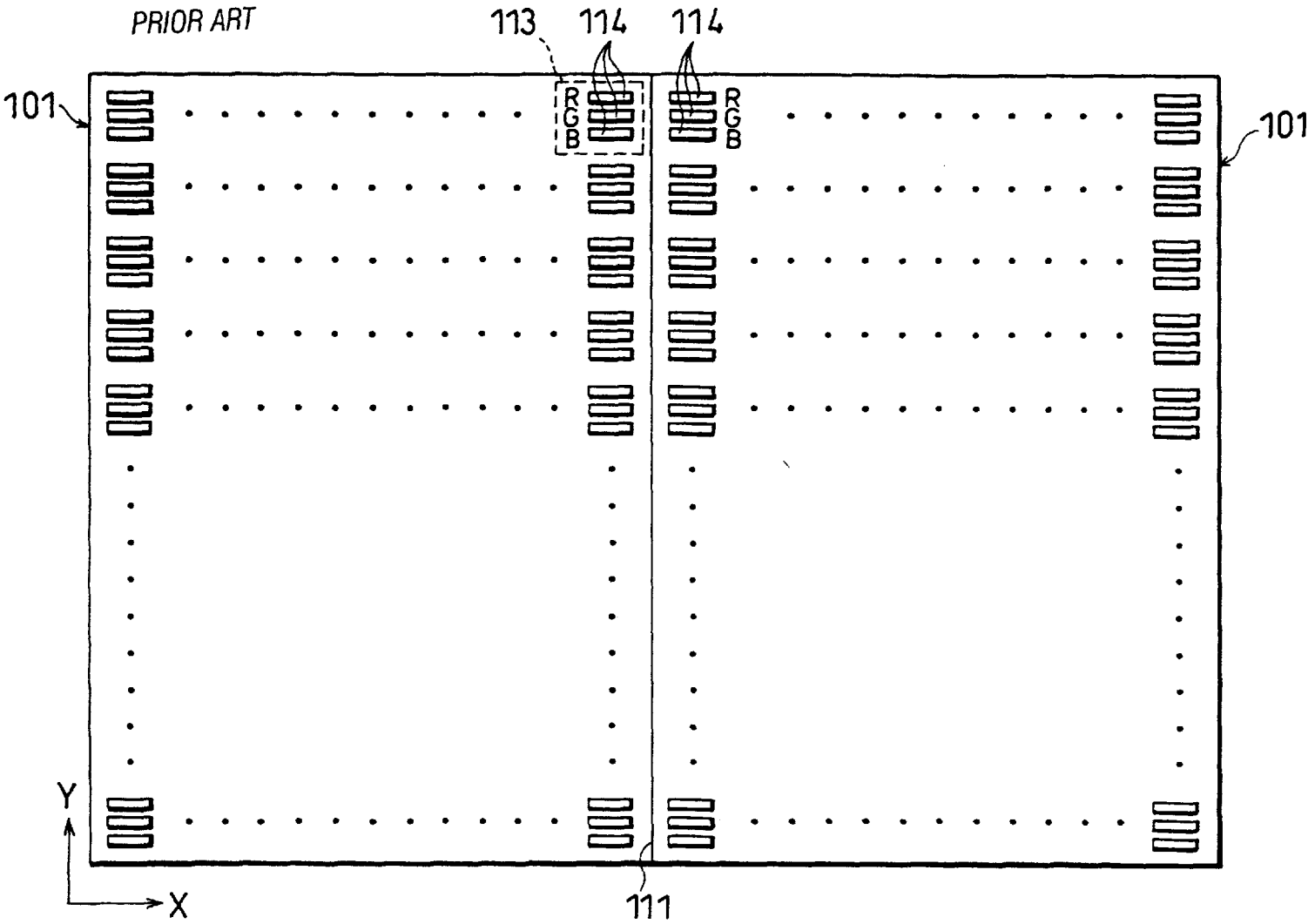
FIG.13 PRIOR ART
FIG. 13 is a schematic plan view of another conventional liquid crystal display device.
Figure 14:
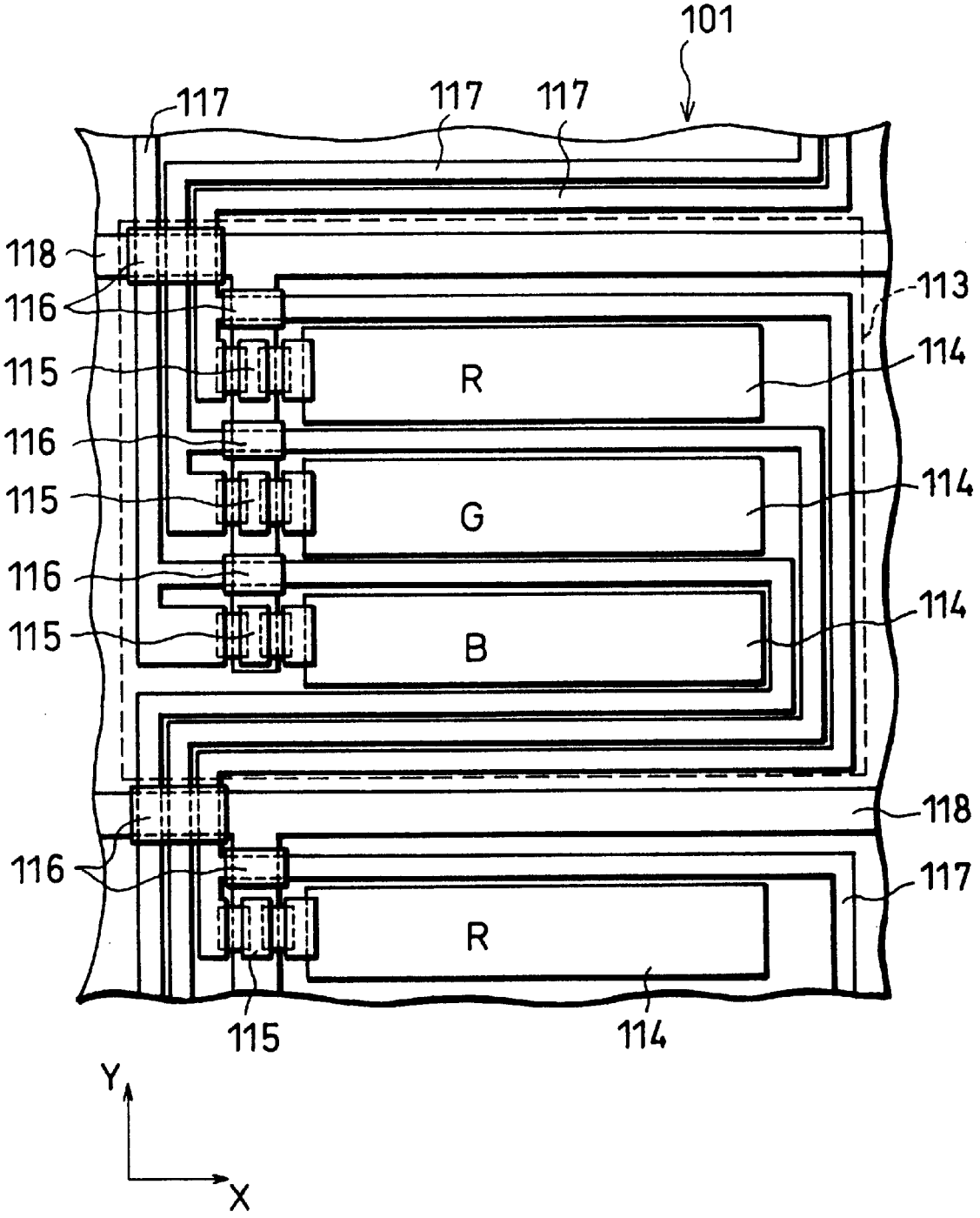
FIG. 14 PRIOR ART
FIG. 14 is a schematic plan view showing in detail a pixel section of the conventional liquid crystal display device.

In a liquid crystal display device fabricated in such a method has the same structure as that of the liquid crystal display device 20 of the present invention shown in FIG. 2. However, as illustrated in FIG. 12, pixels 113 are arranged in matrix form on liquid crystal panels 101 constituting the liquid crystal display device.

In each pixel 113, three pixel electrodes 114 corresponding to color filters of red (R), green (G) and blue (B) are arranged in the RGB order in a direction orthogonal to a connected section 111 (the X-axis direction in FIG. 12), i.e., the up-and-down direction of a displayed image.

In this method, like the liquid crystal display device of the present invention, the connected section 111 of the liquid crystal panels 101 is filled with an index adjusting material having a refractive index which is substantially the same as that of the TFT substrate and counter substrate. It is therefore possible to prevent refraction and scattering of light due to the unevenness of the side faces of the substrates in the connected section 111 of the liquid crystal panels 101. Consequently, it is possible to obtain a displayed image in which the joint in the display is made less noticeable to some degrees.

However, since the distances from the connected section 111 to the respective pixel electrodes 114 of R, G and B differ, the amount of light passing through the color filters (not shown) formed on the pixel electrodes 114 varies. Therefore, when the viewer sees the display from an oblique direction, the color balance of the light passing through the connected section 111 is lost, and the joint in the display becomes noticeable.

On the other hand, in both of the liquid crystal display devices according to Embodiments 1 and 2 of the present invention, since the pixel electrodes are arranged as shown in FIG. 3, it is possible to prevent problems caused by the loss of the color balance. Therefore, the joint in the display can be made less noticeable compared to the above-mentioned method.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device including a liquid crystal panel comprising:

a plurality of pixels arranged in a matrix form;

a plurality of color filters provided in each of said pixels for enabling said pixels to provide a color display, said color filters in each pixel being arranged in a first direction corresponding to an up-and-down direction of a displayed image to be obtained;

pixel electrodes corresponding to said color filters, respectively;

a plurality of scanning lines arranged in the first direction for driving said pixel electrodes; and a plurality of signal lines arranged in a second direction intersecting the first direction for driving said pixel electrodes.

2. The liquid crystal display device as set forth in claim 1, wherein more than one piece of said liquid crystal panel are arranged and connected together at their edges parallel to the first direction so that display surfaces of said liquid crystal panels having said pixels thereon form a plane surface.

3. The liquid crystal display device as set forth in claim 2, wherein each of said liquid crystal panels includes a pair of light transmitting substrates disposed to face each other, and a gap formed in a joint of said liquid crystal panels is filled with an index adjusting material having a refractive index substantially equal to a refractive index of said light transmitting substrates.

4. The liquid crystal display device as set forth in claim 2, wherein said connected liquid crystal panels are fastened to a piece of large transparent substrate.

5. The liquid crystal display device as set forth in claim 4, wherein said connected liquid crystal panels and said large transparent substrate are fastened to each other with an index adjusting material having a refractive index substantially equal to a refractive index of said large transparent substrate.

6. The liquid crystal display device as set forth in claim 2, wherein said connected liquid crystal panels are sandwiched between a pair of polarizing plates whose polarization axes cross at right angles with each other.

7. The liquid crystal display device as set forth in claim 1, further comprising a black matrix which is formed of a light absorbing material so as to separate said pixels from each other.

8. The liquid crystal display device as set forth in claim 1, wherein said scanning lines are disposed to correspond to said pixels arranged in the first direction, and said signal lines are disposed to correspond to said pixels arranged in the second direction.

9. The liquid crystal display device as set forth in claim 1, further comprising data storage means for storing image data for performing line sequential scanning in the first direction, changing an arrangement of the image data and outputting the image data for performing line sequential scanning in the second direction.

10. The liquid crystal display device as set forth in claim 9, further comprising a decoder for decomposing the image data into color image data of primary colors of a displayed color image to be provided, wherein a plurality of said data storage means are provided for each color of said color image data from said decoders.

11. The liquid crystal display device as set forth in claim 9, wherein said data storage means has addresses stored at predetermined intervals according to a display size of said liquid crystal display device, changes an arrangement of the image data stored according to the addresses, and outputs the image data.

12. The liquid crystal display device as set forth in claim 9, wherein said data storage means includes a first storage means and a second storage means for storing and outputting image data according to input and output synchronizing signals so that said first storage means stores image data while said second storage means is outputting image data, and said first storage means outputs image data while said second storage means is storing image data.

13. The liquid crystal display device as set forth in claim 9, further comprising:

an A/D converter for converting the image data in analog form into digital data and storing the digital data as the image data in said data storage means; and a D/A convertor for converting the digital data output from said data storage means after being arranged in a different order into analog data.

14. A method of driving a liquid crystal display device having a liquid crystal panel comprising pixel electrodes, a plurality of scanning lines arranged in a first direction corresponding to an up-and-down direction of a displayed image to be obtained for driving said pixel electrodes, a plurality of signal lines arranged in a second direction intersecting the first direction for driving said pixel electrodes, said method including the steps of:

temporarily storing, in a data storage device having addresses, image data for performing line sequential scanning in the first direction; and changing an arrangement of the image data according to the addresses and outputting the image data for performing line sequential scanning in the second direction.

15. The method of driving a liquid crystal display device as set forth in claim 14, further comprising the steps of:

decomposing the image data into color image data according to primary colors of a color displayed image; and storing the color image data individually.

16. The method of driving a liquid crystal display device as set forth in claim 14, further comprising the steps of:

converting the image data from analog form into digital form before storing the image data; and converting the image data from digital form into analog form after changing an arrangement of the image data for performing line sequential scanning in the second direction.

17. The method of driving a liquid crystal display device as set forth in claim 14, wherein the storage and output of the image data are performed using two paths so that image data is stored through one of the paths while outputting image data through the other path, and image data is output through the one of the paths while storing image data through the other path.

18. The method of driving a liquid crystal display device as set forth in claim 14, wherein storing of image data is performed so that the image data arranged in a predetermined order are stored according to addresses stored at predetermined intervals, and outputting of image data is performed after changing an arrangement of the image data stored according to the addresses.

19. A liquid crystal display device comprising a liquid crystal panel including:

a plurality of pixels arranged in a matrix form;

a plurality of color filters provided in each of said pixels for enabling said pixels to provide a color display, said color filters in each pixel being arranged in a first direction corresponding to an up-and-down direction of a displayed image to be obtained;

pixel electrodes corresponding to said color filters, respectively;

a plurality of signal lines arranged in the first direction for driving said pixel electrodes of each pixel; and a plurality of scanning lines arranged in a second direction intersecting the first direction for driving said pixel electrodes, said scanning lines corresponding to said pixel electrodes arranged in the second direction, respectively.

20. The liquid crystal display device as set forth in claim 19, further comprising:

a decoder for decomposing a piece of image data of a color display into a plurality of color image data corresponding to said pixel electrodes;

data storage means provided for each color for storing the color image data, and outputting the color image data to each pixel electrode so as to perform line sequential scanning of said pixel electrodes in the first direction.

21. A method of driving a liquid crystal display device having a liquid crystal panel comprising pixels arranged in a matrix form, pixel electrodes provided in said pixels, a plurality of signal lines arranged in a first direction that is an up-and-down direction of a displayed image to be obtained for driving said pixel electrodes, a plurality of scanning lines arranged in a second direction intersecting the first direction for driving said pixel electrodes, said method including the steps of:

decomposing image data of a color display into a plurality of color image data corresponding to said pixel electrodes, respectively;

temporarily storing, in a data storage device having addresses, the color image data;

changing an arrangement of the color image data according to the addresses;

outputting the color image data in a predetermined order; and performing line sequential scanning of said pixel electrodes in the first direction according to the color image data.

22. The method of driving a liquid crystal display device as set forth in claim 21, wherein the color image data are stored concurrently, and each piece of the color image data is output individually in a period of time shorter than a storage time during which the color image data are stored so that a period of time during which all of the stored color image data are output is equal to the storage time.

23. The method of driving a liquid crystal display device as set forth in claim 22, wherein the storage and output of the image data are performed using two paths so that image data is stored through one of the paths while outputting image data through the other path, and image data is output through the one of the paths while storing image data through the other path.

* * * * *